US008803414B2

(12) United States Patent
Van De Ven et al.

(10) Patent No.: US 8,803,414 B2
(45) Date of Patent: Aug. 12, 2014

(54) LIGHTING DEVICE

(75) Inventors: Antony Paul Van De Ven, Hong Kong (CN); Wai Kwan Chan, Hong Kong (CN); Chin Wah Ho, Hong Kong (CN); Gerald H. Negley, Durham, NC (US); Dong Lu, Cary, NC (US); Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 55 days.

(21) Appl. No.: 13/465,414

(22) Filed: May 7, 2012

(65) Prior Publication Data

US 2013/0057141 A1 Mar. 7, 2013

Related U.S. Application Data

(60) Provisional application No. 61/530,756, filed on Sep. 2, 2011.

(51) Int. Cl.
*H01J 1/62* (2006.01)

(52) U.S. Cl.
USPC ..... 313/498; 362/296.01

(58) Field of Classification Search
USPC ..... 362/296.1, 300, 307; 313/498–512
See application file for complete search history.

(56) References Cited

U.S. PATENT DOCUMENTS

| | | | | |
|---|---|---|---|---|
| 7,821,023 | B2 | 10/2010 | Yuan et al. | |
| 2007/0268694 | A1 | 11/2007 | Bailey et al. | |
| 2008/0030993 | A1 * | 2/2008 | Narendran et al. | 362/296 |
| 2009/0268455 | A1 | 10/2009 | Allegri | |
| 2009/0283779 | A1 | 11/2009 | Negley et al. | |
| 2010/0259919 | A1 | 10/2010 | Khazi et al. | |
| 2011/0075414 | A1 | 3/2011 | Van De Ven et al. | |

OTHER PUBLICATIONS

U.S. Appl. No. 29/400,957, Sep. 2, 2011, Van De Ven et al.
International Search Report and Written Opinion (PCT/US2012/049719) dated Jan. 18, 2013.

* cited by examiner

*Primary Examiner* — Anne Hines
(74) *Attorney, Agent, or Firm* — Burr & Brown, PLLC

(57) ABSTRACT

A lighting device comprising a solid state light emitter and a light mixing element, in which at least ten of light emitted by the emitter that enters the mixing element is reflected within the mixing element, and the mixing element is not larger than 16 mm. Also, a lighting device comprising an emitter and a mixing element comprising first and second regions. Also, a lighting device comprising a light emitter and a mixing element, in which a light exit region of the mixing element has a surface area between about 50% to about 300% of a surface area of a light entrance region of the mixing element. Also, a lighting device comprising a light emitter, a mixing element and a light output shaping element which defines an exit aperture having a dimension that is at least three times a largest dimension of the first light mixing element.

26 Claims, 13 Drawing Sheets

LIGHTING DEVICE

CROSS-REFERENCE TO RELATED APPLICATION

This application claims the benefit of U.S. Provisional Patent Application No. 61/530,756, filed Sep. 2, 2011, the entirety of which is incorporated herein by reference as if set forth in its entirety.

FIELD OF THE INVENTIVE SUBJECT MATTER

The inventive subject matter relates to the field of general illumination. In some aspects, the inventive subject matter relates to a lighting device that can achieve excellent light mixing in a relatively small space, and/or that can provide a relatively large brightness. In some aspects, the inventive subject matter relates to a lighting device that comprises two or more solid state light emitters that emit light of different colors and that can achieve excellent color mixing in a relatively small space. In some aspects, the inventive subject matter relates to such a lighting device that is of a size and/or shape that is relatively close to a size and/or shape of a conventional lighting device. In some aspects, the inventive subject matter relates to lighting devices that can provide high efficiency and good CRI Ra over long lighting device lifetimes.

BACKGROUND

There is an ongoing effort to develop systems that are more energy-efficient. A large proportion (some estimates are as high as twenty-five percent) of the electricity generated in the United States each year goes to lighting, a large portion of which is general illumination (e.g., downlights, flood lights, spotlights and other general residential or commercial illumination products). Accordingly, there is an ongoing need to provide lighting that is more energy-efficient.

Solid state light emitters (e.g., light emitting diodes) are receiving much attention due to their energy efficiency. It is well known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes than incandescent lights (e.g., fluorescent bulbs typically have lifetimes of 10,000-20,000 hours), but provide less favorable color reproduction. The typical lifetime of conventional fixtures is about 20 years, corresponding to a light-producing device usage of at least about 44,000 hours (based on usage of 6 hours per day for 20 years). Where the light-producing device lifetime of the light emitter is less than the lifetime of the fixture, the need for periodic change-outs is presented. The impact of the need to replace light emitters is particularly pronounced where access is difficult (e.g., vaulted ceilings, bridges, high buildings, highway tunnels) and/or where change-out costs are extremely high.

LED lighting systems can offer a long operational lifetime relative to conventional incandescent and fluorescent bulbs. LED lighting system lifetime is typically measured by an "L70 lifetime", i.e., a number of operational hours in which the light output of the LED lighting system does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein.

LEDs also may be energy efficient, so as to satisfy ENERGY STAR® program requirements. ENERGY STAR program requirements for LEDs are defined in "*ENERGY STAR® Program Requirements for Solid State Lighting Luminaires, Eligibility Criteria*—Version 1.1", Final: Dec. 19, 2008, the disclosure of which is hereby incorporated herein by reference in its entirety as if set forth fully herein.

General illumination devices are typically rated in terms of their color reproduction. Color reproduction is typically measured using the Color Rendering Index (CRI Ra). CRI Ra is a modified average of the relative measurements of how the color rendition of an illumination system compares to that of a reference radiator when illuminating eight reference colors, i.e., it is a relative measure of the shift in surface color of an object when lit by a particular lighting device. The CRI Ra equals 100 if the color coordinates of a set of test colors being illuminated by the illumination system are the same as the coordinates of the same test colors being irradiated by the reference radiator.

Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways—driver response time, however, significantly decreases with lower CRI Ra values (for any given brightness, legibility decreases with lower CRI Ra).

The color of visible light output by a light emitter, and/or the color of blended visible light output by a plurality of light emitters can be represented on either the 1931 CIE (Commission International de I'Eclairage) Chromaticity Diagram or the 1976 CIE Chromaticity Diagram. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). Each point (i.e., each "color point") on the respective Diagrams corresponds to a particular hue. For a technical description of CIE chromaticity diagrams, see, for example, "Encyclopedia of Physical Science and Technology", vol. 7, 230-231 (Robert A Meyers ed., 1987). The spectral colors are distributed around the boundary of the outlined space, which includes all of the hues perceived by the human eye. The boundary represents maximum saturation for the spectral colors.

The 1931 CIE Chromaticity Diagram can be used to define colors as weighted sums of different hues. The 1976 CIE Chromaticity Diagram is similar to the 1931 Diagram, except that similar distances on the 1976 Diagram represent similar perceived differences in color.

The expression "hue", as used herein, means light that has a color shade and saturation that correspond to a specific point on a CIE Chromaticity Diagram, i.e., a point that can be characterized with x,y coordinates on the 1931 CIE Chromaticity Diagram or with u', v' coordinates on the 1976 CIE Chromaticity Diagram.

In the 1931 Diagram, deviation from a point on the Diagram (i.e., "color point") can be expressed either in terms of the x, y coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues that would each be perceived as differing from the specified hue to a common extent (and likewise for loci of points defined as being spaced from a particular hue by other quantities of MacAdam ellipses).

A typical human eye is able to differentiate between hues that are spaced from each other by more than seven MacAdam ellipses (but is not able to differentiate between hues that are spaced from each other by seven or fewer MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$. This formula gives a value, in the scale of the u' v' coordinates, corresponding to the distance between points. The hues defined by a locus of points that are each a common distance from a specified color point consist of hues that would each be perceived as differing from the specified hue to a common extent. For example, a statement that a point is spaced from another point by a particular fraction of a u', v' unit on a 1976 CIE Chromaticity Diagram (e.g., "each point within the first region spaced from each point within the second region by at least 0.01 u', v' units on a 1976 CIE Chromaticity Diagram") indicates that the distance between the respective points (equal to $\Delta u'^2+\Delta v'^2)^{1/2}$ is at least equal to the specified fraction.

The emission spectrum of any particular light emitting diode is typically concentrated around a single wavelength (as dictated by the light emitting diode's composition and structure), which is desirable for some applications, but not desirable for others, (e.g., for providing general illumination, such an emission spectrum by itself would provide a very low CRI Ra).

In many situations (e.g., lighting devices used for general illuminations), the color of light output that is desired differs from the color of light that is output from a single solid state light emitter, and so in many of such situations, combinations of two or more types of solid state light emitters that emit light of different hues are employed. Where such combinations are used, there is often a desire for the light output from the lighting device to have a particular degree of uniformity, i.e., to reduce the variance of the color of light emitted by the lighting device at a particular minimum distance or distances. For example, there may be a desire for "pixelation", the existence of visually perceptible differences in hues in the output light, to be reduced or eliminated at a particular distance (e.g., 18 inches) from a lighting device (e.g., by holding up a sheet of white paper and seeing whether different hues can be perceived), i.e., for adequate mixing of the light emitted by emitters that emit light of different hues to be achieved.

The most common type of general illumination is white light (or near white light), i.e., light that is close to the blackbody locus, e.g., within about 10 MacAdam ellipses of the blackbody locus on a 1931 CIE Chromaticity Diagram. Light with such proximity to the blackbody locus is referred to as "white" light in terms of its illumination, even though some light that is within 10 MacAdam ellipses of the blackbody locus is tinted to some degree, e.g., light from incandescent bulbs is called "white" even though it sometimes has a golden or reddish tint; also, if the light having a correlated color temperature of 1500 K or less is excluded, the very red light along the blackbody locus is excluded.

"White" solid state light emitting lamps have been produced by providing devices that mix different colors of light, e.g., by using light emitting diodes that emit light of differing respective colors and/or by converting some or all of the light emitted from the light emitting diodes using luminescent material. For example, as is well known, some lamps (referred to as "RGB lamps") use red, green and blue light emitting diodes, and other lamps use (1) one or more light emitting diodes that generate blue light and (2) luminescent material (e.g., one or more phosphor materials) that emits yellow light in response to excitation by light emitted by the light emitting diode, whereby the blue light and the yellow light, when mixed, produce light that is perceived as white light. While there is a need for more efficient white lighting, there is in general a need for more efficient lighting in all hues.

Although the development of solid state light emitters (e.g., light emitting diodes) has in many ways revolutionized the lighting industry, some of the characteristics of solid state light emitters have presented challenges, some of which have not yet been fully met.

In order to encourage development and deployment of highly energy efficient solid state lighting (SSL) products to replace several of the most common lighting products currently used in the United States, including 60-Watt A19 incandescent and PAR 38 halogen incandescent lamps, the Bright Tomorrow Lighting Competition (L Prize™) has been authorized in the Energy Independence and Security Act of 2007 (EISA). The L Prize is described in "*Bright Tomorrow Lighting Competition* (L Prize™)", May 28, 2008, Document No. 08NT006643, the disclosure of which is hereby incorporated herein by reference in its entirety as if set forth fully herein. The L Prize winner must conform to many product requirements including light output, wattage, color rendering index, correlated color temperature, expected lifetime, dimensions and base type.

Heat is a major concern in obtaining a desirable operational lifetime for solid state light emitters. As is well known, an LED also generates considerable heat during the generation of light. The heat is generally measured by a "junction temperature", i.e., the temperature of the semiconductor junction of the LED. In order to provide an acceptable lifetime, for example, an L70 of at least 25,000 hours, it is desirable to ensure that the junction temperature should not be above 85° C. In order to ensure a junction temperature that is not above 85° C., various heat sinking schemes have been developed to dissipate at least some of the heat that is generated by the LED. See, for example, Application Note: CLD-APO6.006, entitled *Cree® XLamp® XR Family* & 4550 *LED Reliability*, published at cree.com/xlamp, September 2008.

Many existing lighting devices provide multiple LED sources with lenses to provide control of the light emitted (e.g., to provide a directed beam and/or to reduce glare). It has been found that small lenses provide good efficiency, and so in many cases in the past, where many LED sources have been employed, the LED sources have been individually coupled with optical concentrators, and/or small groups of LED sources ("clusters") have been coupled with optical concentrators.

BRIEF SUMMARY

In some aspects of the present inventive subject matter, there is provided a lighting device that comprises at least a first solid state light emitter and a light mixing element, in which a specified percentage (e.g., at least about 10 percent) of light emitted by the first solid state light emitter that enters the light mixing element is reflected at least once within the light mixing element, and the light mixing element is relatively small in size (e.g., a largest dimension of the light mixing element is not larger than 16 mm).

In some aspects of the present inventive subject matter, there is provided a lighting device that comprises at least a first solid state light emitter and a light mixing element, in which the light mixing element comprises at least two regions, and the light mixing element is relatively small in size (e.g., a largest dimension of the light mixing element is not larger than 16 mm).

In some aspects of the present inventive subject matter, there is provided a lighting device that comprises at least a first solid state light emitter and a light mixing element, in which:

a specified percentage (e.g., at least about 80 percent) of a total amount of light emitted by the first solid state light emitter enters an entrance region of the light mixing element, a specified percentage (e.g., at least about 10 percent) of light emitted by the first solid state light emitter that enters the first light mixing element is reflected at least once within the light mixing element, a specified percentage (e.g., at least about 70 percent) of a total amount of light emitted by the first solid state light emitter that enters the light mixing element exits from an exit region of the light mixing element, and the exit region of the first light mixing element has a surface area within a specified range (e.g., about 50% to about 300% of the surface area of the entrance region).

In some aspects of the present inventive subject matter, there is provided a lighting device that comprises at least a first solid state light emitter, a first light mixing element and a light output shaping element, in which a specified percentage (e.g., at least about 10 percent) of light emitted by the first solid state light emitter that enters the light mixing element is reflected at least once within the light mixing element, at least some light emitted by the first solid state light emitter enters the light mixing element, then exits the light mixing element into the light output shaping element, and then exits the lighting device, and the light output shaping element defines an exit aperture having a specified surface area (e.g., a dimension that is at least about three times a largest dimension of the light mixing element).

In some aspects of the present inventive subject matter, there is provided a lighting device that comprises five or more solid state light emitters (at least two of which emit light of different respective colors) and a light mixing element (for light from those solid state light emitters) in which (1) the light mixing element has an entrance region and an exit region (as defined below), and the ratio of the surface area of the exit region to the surface area of the entrance region is within a specified range (e.g., about 50% to about 300% of the surface area of the entrance region), and/or (2) the light mixing element is relatively small in size (e.g., a largest dimension of the light mixing element is not greater than 16 mm), which can provide a lighting device that emits bright light in a narrow beam, with good color mixing and uniformity' in a comparatively small lighting device.

In some aspects of the present inventive subject matter, there is provided a lighting device that comprises two or more solid state light emitters (at least two of which emit light of different respective colors) that emit at least about 500 lumens, and a light mixing element (for that light of at least about 500 lumens) in which (1) the light mixing element has an entrance region and an exit region (as defined below), and the ratio of the surface area of the exit region to the surface area of the entrance region is within a specified range (e.g., about 0.5 to about 3), and/or (2) the light mixing element is relatively small in size (e.g., a largest dimension of the light mixing element is not greater than 16 mm), which can provide a lighting device that emits bright light in a narrow beam, with good color mixing and uniformity in a comparatively small lighting device.

In some aspects of the present inventive subject matter, there is provided a lighting device that comprises at least first and second solid state light emitters and at least a first light mixing element.

In some aspects of the present inventive subject matter, there is provided a lighting device that comprises at least first and second solid state light emitters and at least a first light output shaping element.

In some aspects of the present inventive subject matter, a light mixing element can be provided between solid state light emitters and a light output shaping element (e.g., a lens and/or a reflector).

In some aspects of the present inventive subject matter, there is provided a lighting device that comprises at least first and second solid state light emitters that emit light of different respective colors, a light mixing element (for light emitted by at least the first and second solid state light emitters) in which the light mixing element has an entrance region and an exit region (as defined below), and a light output shaping element (at least some light emitted by the first and second solid state light emitters entering the light mixing element and then exiting the light mixing element into the light output shaping element) that defines an exit aperture that has a dimension that is at least about three times the largest dimension of the light mixing element.

In accordance with a first aspect of the present inventive subject matter, there is provided a lighting device, comprising:

at least a first solid state light emitter; and at least a first light mixing element, at least some light emitted by the first solid state light emitter entering the first light mixing element and then exiting the first light mixing element, at least about 10 percent (and in some embodiments, at least about 20 percent, at least about 30 percent, at least about 40 percent, at least about 50 percent, at least about 60 percent, at least about 70 percent, at least about 80 percent, or at least about 90 percent) of light emitted by the first solid state light emitter that enters the first light mixing element is reflected at least once within the first light mixing element, and a largest dimension of the first light mixing element is not larger than 16 mm.

In some embodiments in accordance with the first aspect of the present inventive subject matter, at least some of the light that is reflected at least once within the first light mixing element is reflected:

(1) at an external surface of the first light mixing element;

(2) at an interface between a first region of the first light mixing element and a second region of the first light mixing element; and/or (3) at a surface of a second region of the first light mixing element.

In some embodiments in accordance with the first aspect of the present inventive subject matter, at least about 80 percent of a total amount of light emitted by the first solid state light emitter enters an entrance region of the first light mixing element, at least about 70 percent of a total amount of light emitted by the first solid state light emitter that enters the first light mixing element exits from an exit region of the first light mixing element, and the exit region of the first light mixing element has a surface area between about 50% to about 300% of the surface area of the entrance region.

In some of such embodiments:

the entrance region is a minimum surface area region on an external surface of the first light mixing element that has a perimeter that has no inflection points and through which at least about 80 percent of the total amount of light emitted by the first solid state light emitter enters, and/or the exit region is a minimum surface area region on an external surface of the first light mixing element that has a perimeter that has no inflection points and through which at least about 70 percent of the total amount of light emitted by the first solid state light emitter that enters the first light mixing element exits.

In some embodiments in accordance with the first aspect of the present inventive subject matter, the lighting device further comprises at least a first light output shaping element, and at least some light emitted by the first solid state light emitter enters the first light mixing element, then exits the first light mixing element into the first light output shaping element, and then exits the lighting device.

In some embodiments in accordance with the first aspect of the present inventive subject matter:

at least about 80 percent of a total amount of light emitted by the first solid state light emitter enters an entrance region of the first light mixing element, at least about 70 percent of a total amount of light emitted by the first solid state light emitter that enters the first light mixing element exits from an exit region of the first light mixing element, and the lighting device further comprises at least a first light output shaping element that defines an exit aperture having a surface area that is at least about eight times the surface area of the exit region of the first light mixing element.

In some embodiments in accordance with the first aspect of the present inventive subject matter:

at least about 80 percent of a total amount of light emitted by the first solid state light emitter enters an entrance region of the first light mixing element, at least about 70 percent of a total amount of light emitted by the first solid state light emitter that enters the first light mixing element exits from an exit region of the first light mixing element, and the lighting device further comprises at least a first light output shaping element that defines an exit aperture having a surface area that is at least about sixteen times the surface area of the exit region of the first light mixing element.

In some embodiments in accordance with the first aspect of the present inventive subject matter, the first light mixing element comprises at least a first mixing element region and a second mixing element region.

In some of such embodiments:

(1) the first mixing element region comprises a first structure, the second mixing element region comprises a second structure, the first structure is solid and light transmissive, and the second structure is reflective, and/or (2) the second structure comprises at least a first aperture, and the second structure covers a portion of an outer substantially hemispherical surface of the first structure, except for an exit region of the first structure that is exposed to the aperture, and/or (3) the exit region of the first structure includes a point through which an axis of the outer substantially hemispherical surface extends, and/or (4) the exit region of the first structure has a surface area that is not more than 25% of a surface area of the outer substantially hemispherical surface.

In some embodiments in accordance with the first aspect of the present inventive subject matter:

at least about 80 percent of a total amount of light emitted by the first solid state light emitter enters an entrance region of the first light mixing element, at least about 70 percent of a total amount of light emitted by the first solid state light emitter that enters the first light mixing element exits from an exit region of the first light mixing element, and the exit region of the first light mixing element has a surface area of not greater than 403 square millimeters.

In some embodiments in accordance with the first aspect of the present inventive subject matter, at least about 20 percent of light emitted by the first solid state light emitter that enters the first light mixing element is reflected at least once within the first light mixing element.

In some embodiments in accordance with the first aspect of the present inventive subject matter, a brightness of light exiting the first light mixing element is at least about 500 lumens.

In some embodiments in accordance with the first aspect of the present inventive subject matter, the lighting device comprises at least second, third, fourth and fifth solid state light emitters in addition to the first solid state light emitter.

In some of such embodiments:

(1) the lighting device comprises a plurality of solid state light emitters including the first, second, third, fourth and fifth solid state light emitters, and a brightness of light emitted by the plurality of solid state light emitters exiting the first light mixing element is at least about 500 lumens, and/or (2) at least about 20 percent of light emitted by the first, second, third, fourth and fifth solid state light emitters that enters the first light mixing element is reflected at least once within the first light mixing element, and/or (3) the first solid state light emitter is configured to emit light within a first region on a 1976 CIE Chromaticity Diagram, the second solid state light emitter is configured to emit light within a second region on a 1976 CIE Chromaticity Diagram, and each point within the first region is spaced from each point within the second region by at least 0.01 u', v' units on a 1976 CIE Chromaticity Diagram, and/or (4) at least some light emitted by each of the first, second, third, fourth and fifth solid state light emitters enters the first light mixing element and then exits the first light mixing element, and at least about 10 percent of light emitted by the first, second, third, fourth and fifth solid state light emitters that enters the first light mixing element is reflected at least once within the first light mixing element, and/or (5) at least about 80 percent of a total amount of light emitted by the first, second, third, fourth and fifth solid state light emitters enters an entrance region of the first light mixing element, at least about 70 percent of a total amount of light emitted by the first, second, third, fourth and fifth solid state light emitters that enters the first light mixing element exits from an exit region of the first light mixing element, and the exit region of the first light mixing element has a surface area between about 50% to about 300% of the surface area of the entrance region, and/or (6) the entrance region is a minimum surface area region on an external surface of the first light mixing element that has a perimeter that has no inflection points and through which at least about 80 percent of the total amount of light emitted by the first, second, third, fourth and fifth solid state light emitters enters, and/or (7) the exit region is a minimum surface area region on an external surface of the first light mixing element that has a perimeter that has no inflection points and through which at least about 70 percent of the total amount of light emitted by the first, second, third, fourth and fifth solid state light emitters that enters the first light mixing element exits, and/or (8) the lighting device further comprises at least a first light output shaping element, and at least some light emitted by the first solid state light emitter enters the first light mixing element, then exits the first light mixing element into the first light output shaping element, and then exits the lighting device.

In accordance with a second aspect of the present inventive subject matter, there is provided a lighting device, comprising:

at least a first solid state light emitter; and at least a first light mixing element, the first light mixing element comprising at least a first mixing element region and a second mixing element region, at least some light emitted by the first solid state light emitter entering the first light mixing element and then exiting the first light mixing element, a largest dimension of the first light mixing element is not larger than 16 mm.

In some embodiments in accordance with the second aspect of the present inventive subject matter:

the first mixing element region comprises a first structure, the second mixing element region comprises a second structure, the first structure is solid and light transmissive, and the second structure is reflective.

In some of such embodiments:

(1) the second structure comprises at least a first aperture, and the second structure covers a portion of an outer substantially hemispherical surface of the first structure, except for an exit region of the first structure that is exposed to the aperture and/or (2) the exit region of the first structure includes a point through which an axis of the outer substantially hemispherical surface extends, and/or (3) the exit region of the first structure has a surface area that is not more than 25% of a surface area of the outer substantially hemispherical surface.

In some embodiments in accordance with the second aspect of the present inventive subject matter, at least about 10 percent (and in some embodiments, at least about 20 percent, at least about 30 percent, at least about 40 percent, at least about 50 percent, at least about 60 percent, at least about 70 percent, at least about 80 percent, or at least about 90 percent) of light emitted by the first solid state light emitter that enters the first light mixing element is reflected at least once within the first light mixing element.

In some of such embodiments, at least some of the light that is reflected at least once within the first light mixing element is reflected:

(1) at an external surface of the first light mixing element;

(2) at an interface between the first region of the first light mixing element and the second region of the first light mixing element; and/or (3) at a surface of the second region of the first light mixing element.

In some embodiments in accordance with the second aspect of the present inventive subject matter:

at least about 80 percent of a total amount of light emitted by the first solid state light emitter enters an entrance region of the first light mixing element, at least about 70 percent of a total amount of light emitted by the first solid state light emitter that enters the first light mixing element exits from an exit region of the first light mixing element, and the exit region of the first light mixing element has a surface area between about 50% to about 300% of the surface area of the entrance region.

In some embodiments in accordance with the second aspect of the present inventive subject matter, the lighting device further comprises at least a first light output shaping element, and at least some light emitted by the first solid state light emitter enters the first light mixing element, then exits the first light mixing element into the first light output shaping element, and then exits the lighting device.

In some embodiments in accordance with the second aspect of the present inventive subject matter, a brightness of light exiting the first light mixing element is at least about 500 lumens In some embodiments in accordance with the second aspect of the present inventive subject matter, the lighting device comprises at least second, third, fourth and fifth solid state light emitters in addition to the first solid state light emitter.

In some of such embodiments:

(1) the lighting device comprises a plurality of solid state light emitters including the first, second, third, fourth and fifth solid state light emitters, and a brightness of light emitted by the plurality of solid state light emitters exiting the first light mixing element is at least about 500 lumens, and/or (2) at least about 20 percent of light emitted by the first, second, third, fourth and fifth solid state light emitters that enters the first light mixing element is reflected at least once within the first light mixing element, and/or (3) the first solid state light emitter is configured to emit light within a first region on a 1976 CIE Chromaticity Diagram, the second solid state light emitter is configured to emit light within a second region on a 1976 CIE Chromaticity Diagram, and each point within the first region is spaced from each point within the second region by at least 0.01 u', v' units on a 1976 CIE Chromaticity Diagram.

In accordance with a third aspect of the present inventive subject matter, there is provided a lighting device, comprising:

at least a first solid state light emitter; and at least a first light mixing element, at least about 80 percent of a total amount of light emitted by the first solid state light emitter entering an entrance region of the first light mixing element, at least about 10 percent (and in some embodiments, at least about 20 percent, at least about 30 percent, at least about 40 percent, at least about 50 percent, at least about 60 percent, at least about 70 percent, at least about 80 percent, or at least about 90 percent) of light emitted by the first solid state light emitter that enters the first light mixing element is reflected at least once within the first light mixing element, at least about 70 percent of a total amount of light emitted by the first solid state light emitter that enters the first light mixing element exiting from an exit region of the first light mixing element, and the exit region of the first light mixing element having a surface area between about 50% to about 300% of the surface area of the entrance region.

In some embodiments in accordance with the third aspect of the present inventive subject matter, the entrance region is a minimum surface area region on an external surface of the first light mixing element that has a perimeter that has no inflection points and through which at least about 80 percent of the total amount of light emitted by the first solid state light emitter enters.

In some embodiments in accordance with the third aspect of the present inventive subject matter, the exit region is a minimum surface area region on an external surface of the first light mixing element that has a perimeter that has no inflection points and through which at least about 70 percent of the total amount of light emitted by the first solid state light emitter that enters the first light mixing element exits.

In some embodiments in accordance with the third aspect of the present inventive subject matter, the lighting device further comprises at least a first light output shaping element, and at least some light emitted by the first solid state light emitter enters the first light mixing element, then exits the first light mixing element into the first light output shaping element, and then exits the lighting device.

In some of such embodiments:

(1) the first light output shaping element defines an exit aperture having a surface area that is at least about eight times the surface area of the exit region of the first light mixing element, and/or (2) the first light output shaping element defines an exit aperture having a surface area that is at least about sixteen times the surface area of the exit region of the first light mixing element.

In some embodiments in accordance with the third aspect of the present inventive subject matter, the lighting device comprises at least second, third, fourth and fifth solid state light emitters in addition to the first solid state light emitter.

In accordance with a fourth aspect of the present inventive subject matter, there is provided a lighting device, comprising:

at least a first solid state light emitter;

at least a first light mixing element; and at least a first light output shaping element, at least about 10 percent (and in some embodiments, at least about 20 percent, at least about 30 percent, at least about 40 percent, at least about 50 percent, at least about 60 percent, at least about 70 percent, at least about 80 percent, or at least about 90 percent) of light emitted by the first solid state light emitter that enters the first light mixing element is reflected at least once within the first light mixing element, at least some light emitted by the first solid state light emitter entering the first light mixing element, then exiting the first light mixing element into the first light output shaping element, and then exiting the lighting device, and the first light output shaping element defining an exit aperture having a dimension that is at least about three times a largest dimension of the first light mixing element.

In some embodiments in accordance with the fourth aspect of the present inventive subject matter:

at least some of the light that is reflected at least once within the first light mixing element is reflected:

(1) at an external surface of the first light mixing element;

(2) at an interface between a first region of the first light mixing element and a second region of the first light mixing element; and/or (3) at a surface of a second region of the first light mixing element.

In some embodiments in accordance with the fourth aspect of the present inventive subject matter, the lighting device comprises at least second, third, fourth and fifth solid state light emitters in addition to the first solid state light emitter.

In some embodiments in accordance with the fourth aspect of the present inventive subject matter, the lighting device comprises a plurality of solid state light emitters including the first solid state light emitter, and a brightness of light emitted by the plurality of solid state light emitters exiting the first light mixing element is at least about 500 lumens In some embodiments in accordance with the fourth aspect of the present inventive subject matter, the exit aperture has a dimension that is at least about six times the largest dimension of the first light mixing element.

In accordance with another aspect of the present inventive subject matter, there is provided a lighting device, comprising:

at least first, second, third, fourth and fifth solid state light emitters; and at least a first light mixing element, the first solid state light emitter configured to emit light within a first region on a 1976 CIE Chromaticity Diagram, the second solid state light emitter configured to emit light within a second region on a 1976 CIE Chromaticity Diagram, each point within the first region spaced from each point within the second region by at least 0.01 u', v' units on a 1976 CIE Chromaticity Diagram, at least some light emitted by each of the first, second, third, fourth and fifth solid state light emitters entering the first light mixing element, then exiting the first light mixing element, and a largest dimension of the first light mixing element is not larger than 16 mm.

In accordance with another aspect of the present inventive subject matter, there is provided a lighting device, comprising:

at least first, second, third, fourth and fifth solid state light emitters; and at least a first light mixing element, the first solid state light emitter configured to emit light within a first region on a 1976 CIE Chromaticity Diagram, the second solid state light emitter configured to emit light within a second region on a 1976 CIE Chromaticity Diagram, each point within the first region spaced from each point within the second region by at least 0.01 u', v' units on a 1976 CIE Chromaticity Diagram, at least about 80 percent of a total amount of light emitted by the first, second, third, fourth and fifth solid state light emitters entering an entrance region of the first light mixing element, at least about 70 percent of a total amount of light emitted by the first, second, third, fourth and fifth solid state light emitters that enters the first light mixing element exiting from an exit region of the first light mixing element, and the exit region of the first light mixing element having a surface area between about 50% to about 300% of the surface area of the entrance region.

In accordance with another aspect of the present inventive subject matter, there is provided a lighting device, comprising:

at least a first light mixing element; and a plurality of solid state light emitters comprising at least first and second solid state light emitters, a brightness of light emitted by the plurality of solid state light emitters exiting the first light mixing element is at least about 500 lumens, the first solid state light emitter configured to emit light within a first region on a 1976 CIE Chromaticity Diagram, the second solid state light emitter configured to emit light within a second region on a 1976 CIE Chromaticity Diagram, each point within the first region spaced from each point within the second region by at least 0.01 u', v' units on a 1976 CIE Chromaticity Diagram, at least some light emitted by each of the plurality of solid state light emitters entering the first light mixing element, then exiting the first light mixing element, and a largest dimension of the first light mixing element is not larger than 16 mm.

In accordance with another aspect of the present inventive subject matter, there is provided a lighting device, comprising:

at least a first light mixing element; and a plurality of solid state light emitters comprising at least first and second solid state light emitters, a brightness of light emitted by the plurality of solid state light emitters exiting the first light mixing element is at least about 500 lumens, the first solid state light emitter configured to emit light within a first region on a 1976 CIE Chromaticity Diagram, the second solid state light emitter configured to emit light within a second region on a 1976 CIE Chromaticity Diagram, each point within the first region spaced from each point within the second region by at least 0.01 u', v' units on a 1976 CIE Chromaticity Diagram, at least about 80 percent of a total amount of light emitted by the plurality of solid state light emitters entering an entrance region of the first light mixing element, at least about 70 percent of a total amount of light emitted by the plurality of solid state light emitters that enters the first light mixing element exiting from an exit region of the first light mixing element, and the exit region of the first light mixing element having a surface area between about 50% to about 300% of the surface area of the entrance region.

In accordance with another aspect of the present inventive subject matter, there is provided a lighting device, comprising:

at least first and second solid state light emitters;

at least a first light mixing element; and at least a first light output shaping element, the first solid state light emitter configured to emit light within a first region on a 1976 CIE Chromaticity Diagram, the second solid state light emitter configured to emit light within a second region on a 1976 CIE Chromaticity Diagram, each point within the first region spaced from each point within the second region by at least 0.01 u', v' units on a 1976 CIE Chromaticity Diagram, at least some light emitted by each of the first and second solid state light emitters entering the first light mixing element, then exiting the first light mixing element into the first light output shaping element, and then exiting the lighting device, and the first light output shaping element defining an exit aperture having a dimension that is at least about three times a largest dimension of the first light mixing element.

In accordance with another aspect of the present inventive subject matter, there is provided a lighting device, comprising:

at least first, second, third, fourth and fifth solid state light emitters; and at least a first light mixing element, the first solid state light emitter configured to emit light within a first region on a 1976

CIE Chromaticity Diagram, the second solid state light emitter configured to emit light within a second region on a 1976 CIE Chromaticity Diagram, each point within the first region spaced from each point within the second region by at least 0.01 u', v' units on a 1976 CIE Chromaticity Diagram, at least some light emitted by each of the first, second, third, fourth and fifth solid state light emitters entering the first light mixing element, then exiting the first light mixing element, at least about 10 percent (and in some embodiments, at least about 20 percent) of light emitted by the first, second, third, fourth and fifth solid state light emitters that enters the first light mixing element is reflected at least once within the first light mixing element, and a largest dimension of the first light mixing element is not larger than 16 mm.

In accordance with another aspect of the present inventive subject matter, there is provided a lighting device, comprising:

at least first, second, third, fourth and fifth solid state light emitters; and at least a first light mixing element, the first solid state light emitter configured to emit light within a first region on a 1976 CIE Chromaticity Diagram, the second solid state light emitter configured to emit light within a second region on a 1976 CIE Chromaticity Diagram, each point within the first region spaced from each point within the second region by at least 0.01 u', v' units on a 1976 CIE Chromaticity Diagram, at least about 80 percent of a total amount of light emitted by the first, second, third, fourth and fifth solid state light emitters entering an entrance region of the first light mixing element, at least about 10 percent (and in some embodiments, at least about 20 percent) of light emitted by the first, second, third, fourth and fifth solid state light emitters that enters the first light mixing element is reflected at least once within the first light mixing element, at least about 70 percent of a total amount of light emitted by the first, second, third, fourth and fifth solid state light emitters that enters the first light mixing element exiting from an exit region of the first light mixing element, and the exit region of the first light mixing element having a surface area between about 50% to about 300% of the surface area of the entrance region.

In accordance with another aspect of the present inventive subject matter, there is provided a lighting device, comprising:

at least a first light mixing element; and a plurality of solid state light emitters comprising at least first and second solid state light emitters, a brightness of light emitted by the plurality of solid state light emitters exiting the first light mixing element is at least about 500 lumens, the first solid state light emitter configured to emit light within a first region on a 1976 CIE Chromaticity Diagram, the second solid state light emitter configured to emit light within a second region on a 1976 CIE Chromaticity Diagram, each point within the first region spaced from each point within the second region by at least 0.01 u', v' units on a 1976 CIE Chromaticity Diagram, at least some light emitted by each of the plurality of solid state light emitters entering the first light mixing element, then exiting the first light mixing element, at least about 10 percent (and in some embodiments, at least about 20 percent) of light emitted by the plurality of solid state light emitters that enters the first light mixing element is reflected at least once within the first light mixing element, and a largest dimension of the first light mixing element is not larger than 16 mm.

In accordance with another aspect of the present inventive subject matter, there is provided a lighting device, comprising:

at least a first light mixing element; and a plurality of solid state light emitters comprising at least first and second solid state light emitters, a brightness of light emitted by the plurality of solid state light emitters exiting the first light mixing element is at least about 500 lumens, the first solid state light emitter configured to emit light within a first region on a 1976 CIE Chromaticity Diagram, the second solid state light emitter configured to emit light within a second region on a 1976 CIE Chromaticity Diagram, each point within the first region spaced from each point within the second region by at least 0.01 u', v' units on a 1976 CIE Chromaticity Diagram, at least about 80 percent of a total amount of light emitted by the plurality of solid state light emitters entering an entrance region of the first light mixing element, at least about 10 percent (and in some embodiments, at least about 20 percent) of light emitted by the plurality of solid state light emitters that enters the first light mixing element is reflected at least once within the first light mixing element, at least about 70 percent of a total amount of light emitted by the plurality of solid state light emitters that enters the first light mixing element exiting from an exit region of the first light mixing element, and the exit region of the first light mixing element having a surface area between about 50% to about 300% of the surface area of the entrance region.

In accordance with another aspect of the present inventive subject matter, there is provided a lighting device, comprising:

at least first and second solid state light emitters;

at least a first light mixing element; and at least a first light output shaping element, the first solid state light emitter configured to emit light within a first region on a 1976 CIE Chromaticity Diagram, the second solid state light emitter configured to emit light within a second region on a 1976 CIE Chromaticity Diagram, each point within the first region spaced from each point within the second region by at least 0.01 u', v' units on a 1976 CIE Chromaticity Diagram, at least about 10 percent (and in some embodiments, at least about 20 percent) of light emitted by the plurality of solid state light emitters that enters the first light mixing element is reflected at least once within the first light mixing element, at least some light emitted by each of the first and second solid state light emitters entering the first light mixing element, then exiting the first light mixing element into the first light output shaping element, and then exiting the lighting device, and the first light output shaping element defining an exit aperture having a dimension that is at least about six times a largest dimension of the first light mixing element.

The inventive subject matter may be more fully understood with reference to the accompanying drawings and the following detailed description of the inventive subject matter.

BRIEF DESCRIPTION OF THE DRAWING FIGURES

Figure 5:
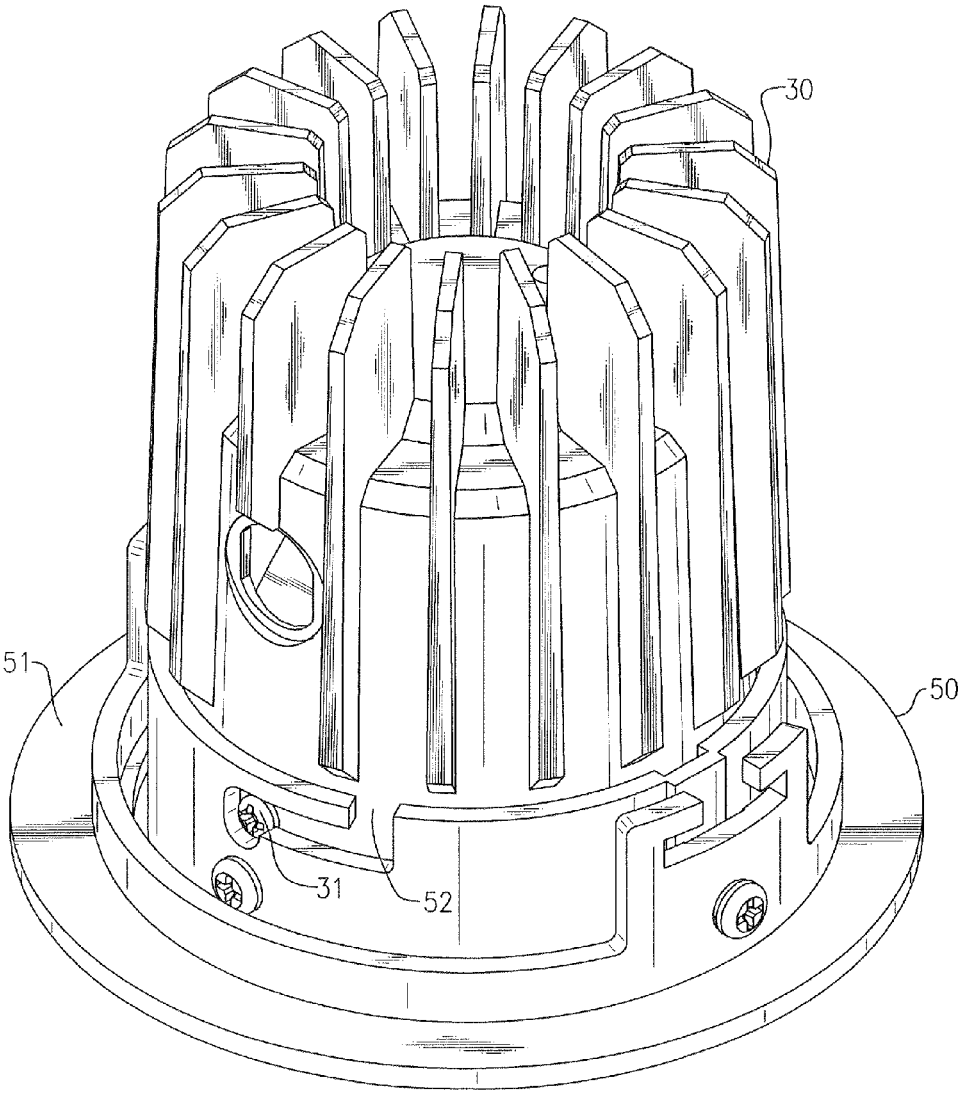
Figure 6:
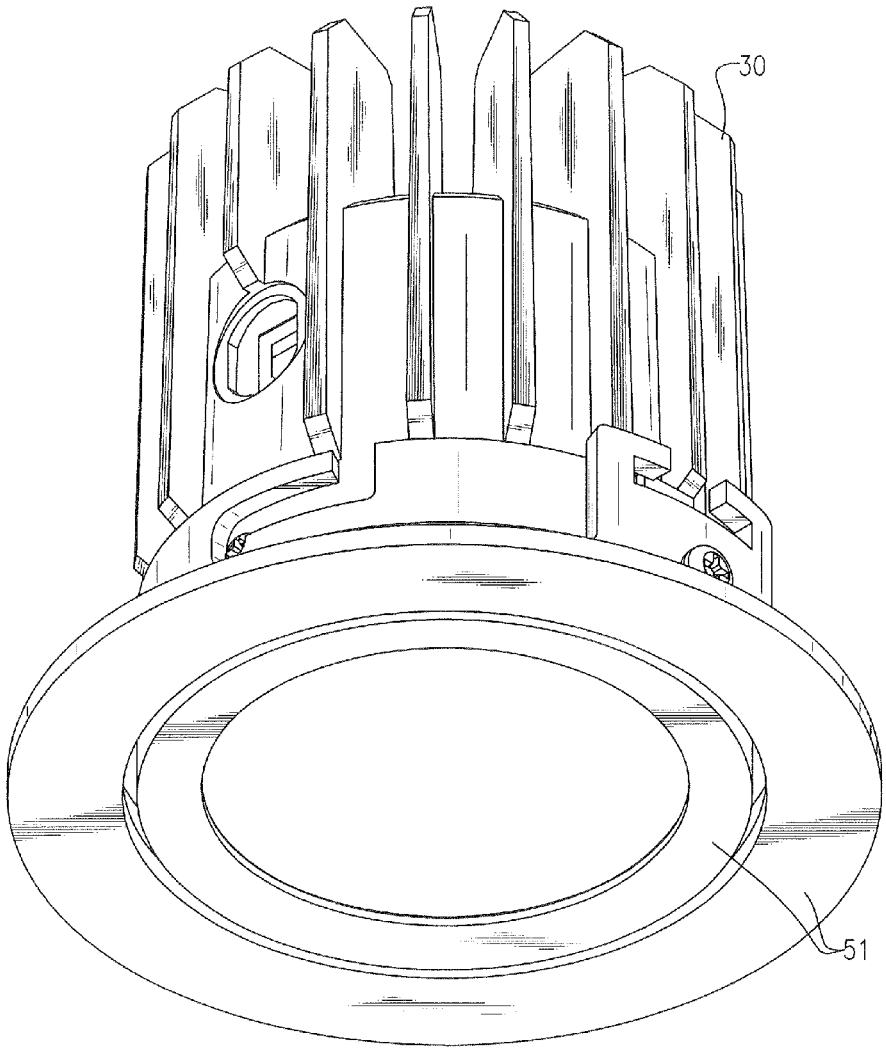

FIGS. 5 and 6 are perspective views showing the lighting device 30 mounted in a fixture 50.

Figure 7:
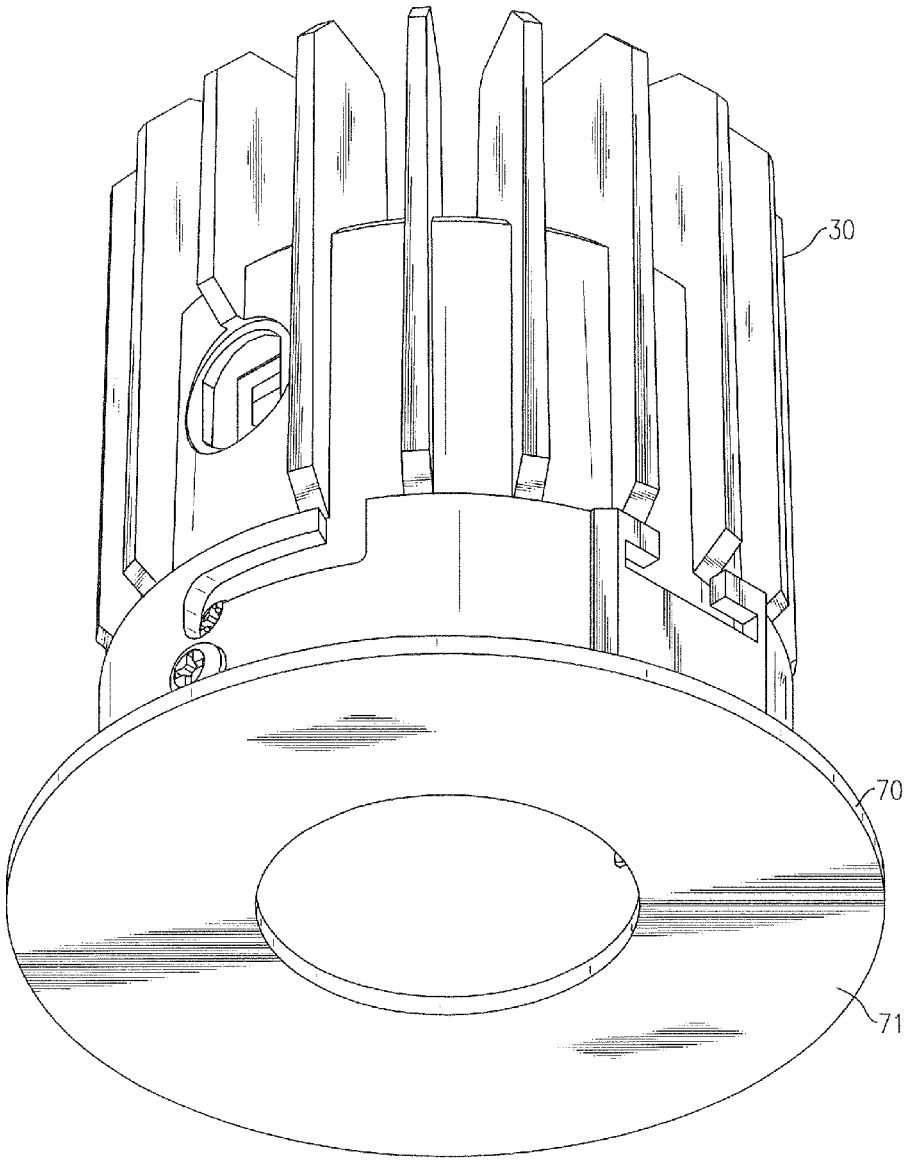

FIG. 7 is a perspective view showing the lighting device 30 mounted in a fixture 70.

Figure 8:
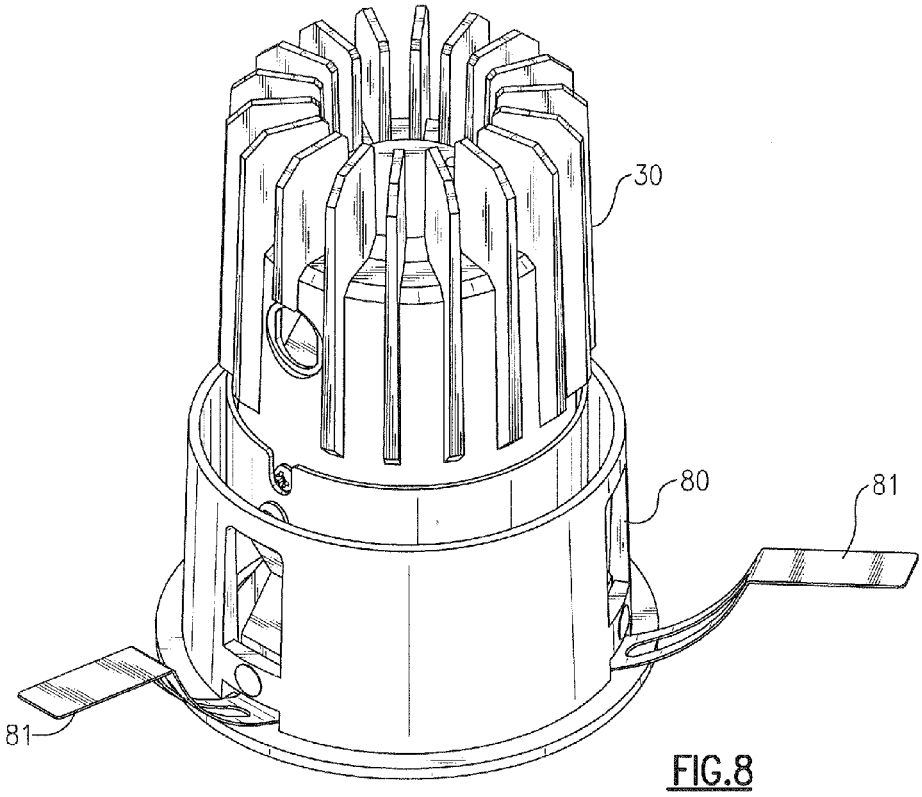
Figure 9:
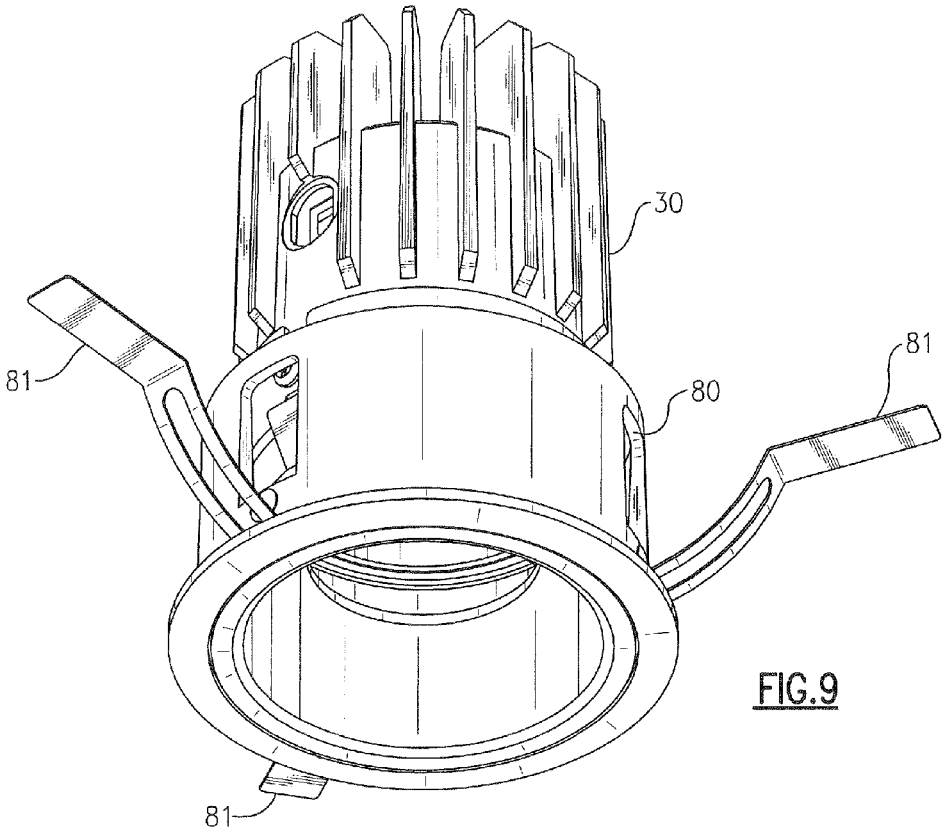

FIGS. 8 and 9 are perspective views showing the lighting device 30 mounted in a fixture 80.

Figure 10:
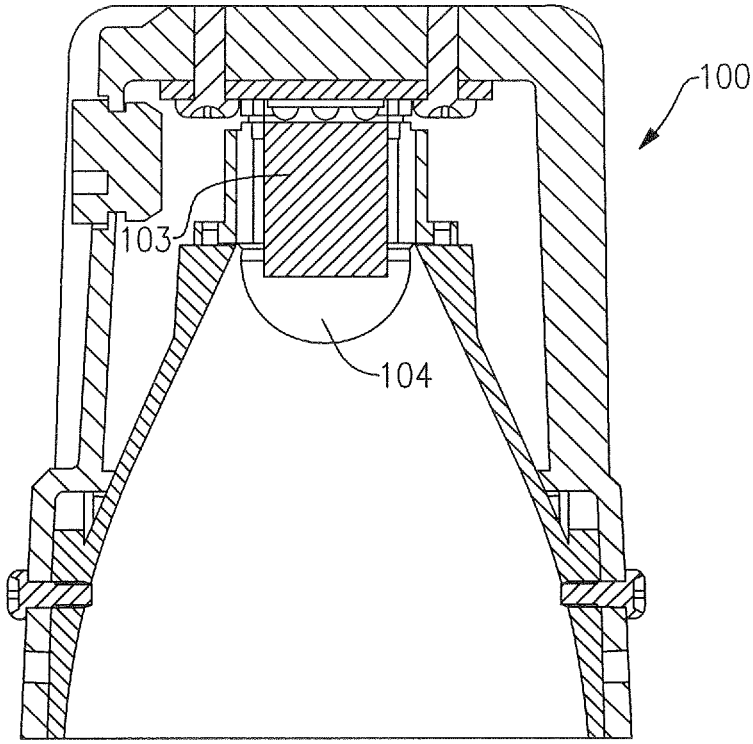

FIG. 10 is a sectional view of a lighting device according to the present inventive subject matter.

Figure 11:
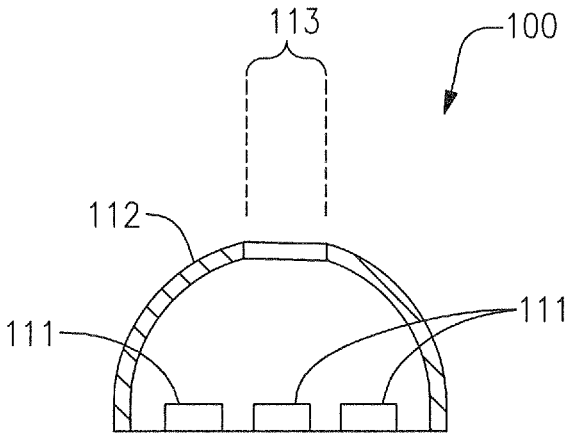

FIG. 11 is a sectional view of a portion of a lighting device.

Figure 12:
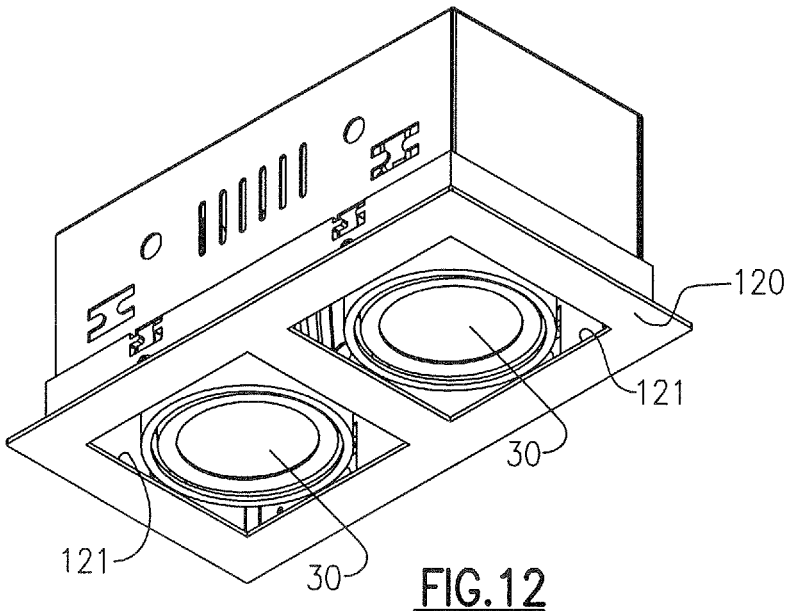

FIG. 12 is a perspective view showing two lighting devices 30 mounted in a fixture 120.

Figure 13:
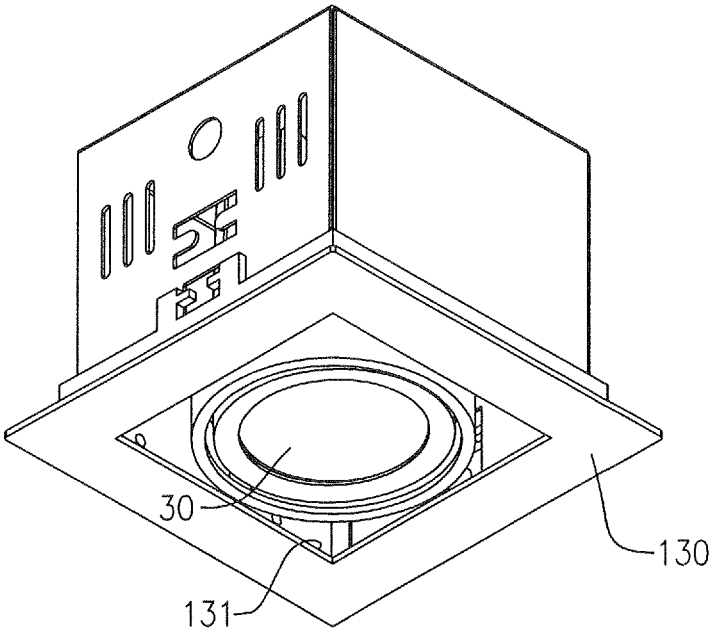

FIG. 13 is a perspective view showing a lighting device 30 mounted in a fixture 130.

DETAILED DESCRIPTION

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout.

As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on", being mounted "to", or extending "onto" another element, it can be in or on the other element, and/or it can be directly on the other element, and/or it can extend directly onto the other element, and it can be in direct contact or indirect contact with the other element (e.g., intervening elements may also be present). In contrast, when an element is referred to herein as being "directly on" or extending "directly onto" another element, there are no intervening elements present. Also, when an element is referred to herein as being "connected" or "coupled" to another element, it can be directly connected or coupled to the other element, or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top", "above," "horizontal" or "vertical" may be used herein to describe one element's relationship to another element (or to other elements) as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower" can therefore encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can therefore encompass both an orientation of above and below.

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting, work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

Some embodiments of the present inventive subject matter comprise at least a first power line, and some embodiments of the present inventive subject matter are directed to a structure comprising a surface and at least one lighting device corresponding to any embodiment of a lighting device according to the present inventive subject matter as described herein, wherein if current is supplied to the first power line, and/or if at least one solid state light emitter in the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As discussed above, lighting devices in accordance with the present inventive subject matter comprise one or more solid state light emitters.

Persons of skill in the art are familiar with, and have ready access to, a wide variety of solid state light emitters, and any suitable solid state light emitters can be employed in the lighting devices according to the present inventive subject matter. Representative examples of solid state light emitters include light emitting diodes (inorganic or organic, including polymer light emitting diodes (PLEDs)) and a wide variety of luminescent materials, as well as combinations (e.g., one or more light emitting diodes and/or one or more luminescent materials, such as a package comprising a light emitting diode and a luminescent material).

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) and/or the type of electromagnetic radiation (e.g., infrared light, visible light, ultraviolet light, near ultraviolet light, etc., and any combinations thereof) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode, various wire connections, and a package that encapsulates the light emitting diode.

A luminescent material is a material that emits a responsive radiation (e.g., visible light) when excited by a source of exciting radiation. In many instances, the responsive radiation has a wavelength (or hue) that is different from the wavelength (or hue) of the exciting radiation.

Luminescent materials can be categorized as being down-converting, i.e., a material that converts photons to a lower energy level (longer wavelength) or up-converting, i.e., a material that converts photons to a higher energy level (shorter wavelength).

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

One type of luminescent material are phosphors, which are readily available and well known to persons of skill in the art. Other examples of luminescent materials include scintillators, day glow tapes and inks that glow in the visible spectrum upon illumination with ultraviolet light.

One non-limiting representative example of a luminescent material that can be employed in the present inventive subject matter is cerium-doped yttrium aluminum garnet (aka "YAG:Ce" or "YAG"). Another non-limiting representative example of a luminescent material that can be employed in the present inventive subject matter is CaAlSiN:Eu2+ (aka "CASN" or "BR01"), and a further example of a type of luminescent material is BOSE.

The one or more luminescent materials can be provided in any suitable form. For example, the luminescent element can be embedded in a resin (i.e., a polymeric matrix), such as a silicone material, an epoxy material, a glass material or a metal oxide material, and/or can be applied to one or more surfaces of a resin, to provide a lumiphor.

As noted above, in some embodiments in accordance with the present inventive subject matter, which can include or not include, as suitable, any of the other features described herein, light of two or more different colors is emitted by respective solid state light emitters, and is mixed in a light mixing element (or chambers). The expression "different colors" refers to a device that comprises at least first and second solid state light emitters, the first solid state light emitter configured to emit light within a first region on a 1976 CIE Chromaticity Diagram, the second solid state light emitter configured to emit light within a second region on a 1976 CIE Chromaticity Diagram, each point within the first region spaced from each point within the second region by at least 0.01 u', v' units on a 1976 CIE Chromaticity Diagram.

In general, light of any combination and number of colors can be mixed in lighting devices according to the present inventive subject matter. For instance, examples of colors of light that can be mixed are (1) red, green and blue (i.e., an RGB arrangement), (2) BSY light (defined below) and red light, (3) BSY light and BSR light (defined below).

The expression "BSY light", as used herein, means light having x, y color coordinates which define a point which is within (1) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38, and/or (2) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.29, 0.36, the second point having x, y coordinates of 0.32, 0.35, the third point having x, y coordinates of 0.41, 0.43, the fourth point having x, y coordinates of 0.44, 0.49, and the fifth point having x, y coordinates of 0.38, 0.53 (in the 1976 CIE Chromaticity Diagram, the first point has u', v' coordinates of 0.17, 0.48, the second point has u', v' coordinates of 0.20, 0.48, the third point has u', v' coordinates of 0.22, 0.53, the fourth point has u', v' coordinates of 0.22, 0.55, and the fifth point has u', v' coordinates of 0.18, 0.55)

The expression "BSR light", as used herein, means light having x, y color coordinates which define a point which is within an area on a 1931 CIE Chromaticity Diagram enclosed by first, second, third and fourth line segments, the first line segment connecting a first point to a second point, the second line segment connecting the second point to a third point, the third line segment connecting the third point to a fourth point, the fourth line segment connecting the fourth point to the first point, the first point having x, y coordinates of 0.57, 0.35, the second point having x, y coordinates of 0.62, 0.32, the third point having x, y coordinates of 0.37, 0.16, and the fourth point having x, y coordinates of 0.40, 0.23.

The one or more solid state light emitters in lighting devices in accordance with the present inventive subject matter can generally be arranged in any suitable way. In some embodiments in accordance with the present inventive subject matter, which can include or not include, as suitable, any of the other features described herein, the solid state light emitters can be relatively tightly packed together, e.g., the surface area a region that has a perimeter that extends around all of the solid state light emitters and that has no inflection points is not much greater (e.g., not more than 10% larger, not more than 15% larger, not more than 20% larger, not more than 25% larger, not more than 30% larger, not more than 35% larger, or not more than 40% larger) than the combined surface area of the emission surfaces of the solid state light emitters.

For example, in some embodiments in accordance with the present inventive subject matter, 25 or more light emitting diode chips can be packed in an area not larger than 65 square millimeters (e.g., in a 8 mm×8 mm square area).

In some embodiments in accordance with the present inventive subject matter, 50 or more light emitting diode chips can be packed in an area not larger than 145 square millimeters (e.g., in a 12 mm×12 mm square area).

In some embodiments in accordance with the present inventive subject matter, 58 or more light emitting diode die can be packed in an area not larger than 50 square millimeters (e.g., in a 7 mm×7 mm square area).

In some embodiments in accordance with the present inventive subject matter, light emitting diode chips that emit at least about 2000 lumens can be packed in an area not larger than 100 square millimeters (e.g., in a 10 mm×10 mm square area).

Solid state light emitters can be mounted (e.g., on one or more circuit board or directly on a housing or a light output shaping element, etc.) in any suitable way, e.g., by using chip on heat sink mounting techniques, by soldering (e.g., if the lighting device comprises a metal core printed circuit board (MCPCB), flex circuit or even a standard PCB, such as an FR4 board with thermal vias), for example, solid state light emitters can be mounted using substrate techniques such as from Themastrate Ltd of Northumberland, UK. If desired, a surface on which solid state light emitters are to be mounted and/or the solid state light emitters can be machined or otherwise formed to be of matching topography so as to provide high heat sink surface area and/or good adhesion or other properties Respective solid state light emitters or groups of solid state light emitters can be electrically connected in any suitable pattern, e.g., in parallel, in series, in series parallel (e.g., in a series of subsets, each subset comprising two or more (e.g., three) solid state light emitters arranged in parallel), in a single string or in two or more strings, etc.

As discussed above, lighting devices in accordance with the present inventive subject matter comprise at least a first light mixing element.

In some embodiments in accordance with the present inventive subject matter, which can include or not include, as suitable, any of the other features described herein, a light mixing element can comprise one or more regions that are at least partially reflective, and/or one or more regions that are at least partially refractive, and/or one or more regions that provide some degree of light scattering. In such embodiments, the location(s) of any such regions, and the degree of reflectivity, refraction and/or scattering can be tailored to provide any suitable combination of light reflecting, refracting and/or scattering properties.

In some embodiments in accordance with the present inventive subject matter, which can include or not include, as suitable, any of the other features described herein, a light mixing element can comprise at least one light transmissive region (i.e., a region through which at least some light can travel, and in some instances, allows passage of at least about 80% of incident visible light, at least about 85% of incident visible light, at least about 90% of incident visible light, etc.) and/or at least one light reflecting region. Persons of skill in the art are familiar with, have access to, and can readily make a variety of light mixing elements that comprise at least one light transmissive region and/or at least one light reflecting region. Any such transmissive region(s) and/or light reflecting region(s) can optionally comprise any suitable optical features.

For example, a representative example of a suitable light mixing element can comprise at least one light transmissive region (which can be in the shape of a hemisphere, a cube, an orthogonal structure, a prismatic structure, a pyramidal structure, or any other shape, and which can be solid, liquid, plasma, gaseous, hollow, porous, or any combination of one or more solid regions, one or more liquid regions, one or more plasma regions, one or more gaseous regions and/or one or more hollow regions) and/or at least one light reflective region (which can similarly be in any suitable shape, and which can comprise any combination of solid regions, liquid regions, plasma regions, gaseous regions and hollow regions), and/or at least one aperture (e.g., a hole in a reflective chamber wall through which light can escape).

In some embodiments in accordance with the present inventive subject matter, which can include or not include, as suitable, any of the other features described herein, a light mixing element can be provided which has at least one entrance region, through which at least a portion of light emitted by at least some of the solid state light emitters in the lighting device enters the light mixing element, and at least one exit region, through which light exiting the light mixing element exits. In some embodiments in accordance with the present inventive subject matter, which can include or not include, as suitable, any of the other features described herein, one or more entrance regions is/are configured so as to allow a high percentage of light emitted by solid state light emitters to enter the light mixing element through such entrance region(s) (e.g., to optimize or maximize such percentage), and/or one or more exit regions is/are configured so as to allow a high percentage of light that enters the light mixing element to exit the light mixing element through the exit region(s) (e.g., to optimize or maximize such percentage).

Surfaces and interior regions of a light mixing element employed in accordance with the present inventive subject matter can have any suitable reflective and/or refractive properties, and respective portions of such surfaces and/or interior regions can have reflective and/or refractive properties that differ from other portions of such surfaces and/or interior regions, in order to provide a desired flow of light into, through and out of the light mixing element, and persons of skill in the art are familiar with a wide variety of techniques for doing so, any of which (or any combination of which) can be employed.

Merely to provide a representative example of a light mixing element, a light mixing element can comprise a hollow hemispherical structure with a first aperture on the "flat" side to serve as an entrance region through which light from solid state light emitters enters the light mixing element, and a second aperture on the portion farthest from the flat side to serve as an exit region through which mixed light exits the light mixing element. In such an example, light of different colors can enter the light mixing element through the first aperture, be repeatedly reflected (and optionally also refracted and/or scattered) by the interior surfaces of the light mixing element to be thoroughly mixed, and exit from the second aperture.

To provide another representative example of a light mixing element, a light mixing element can comprise a solid light transmissive hemispherical structure in which the "flat" side serves as an entrance region through which light from solid state light emitters enters the light mixing element, and the portion farthest from the flat side serves as an exit region through which mixed light exits the light mixing element. In such an example, light of different colors can enter the light mixing element through the flat side, be repeatedly reflected (and optionally also refracted and/or scattered) by the light mixing element to be thoroughly mixed, and exit from the exit region. In a specific representative example of such a light mixing element, respective portions of surfaces (and/or interior regions) of the light mixing element can have any suitable reflective and/or refractive and/or scattering properties, e.g., the flat side can be less reflective, and the curved side, except for the exit region, can be more reflective, in order to provide a desired flow of light into, through and out of the light mixing element.

In some embodiments in accordance with the present inventive subject matter, which can include or not include, as suitable, any of the other features described herein, a light mixing element can have an entrance region that can have a cross-sectional area that is about the same size (or between 75% and 130% of the size) as a region on which are the solid state light emitters that emit light that enters the light mixing element (e.g., a region defined by a perimeter that does not have any points of inflection (the expression "points of inflection" as used herein, e.g., in the expression "a perimeter that does not have any points of inflection" refers to a continuous border that can have one or more straight portions, one or more angled portions and/or one or more curved portions that has no inflection points (i.e., no points where the sign of curvature or concavity changes)).

In some representative embodiments in accordance with the present inventive subject matter, an entrance region of a light mixing element can comprise emission surfaces of solid state light emitters that are in contact with the light mixing element.

In some representative embodiments in accordance with the present inventive subject matter, an entrance region of a light mixing element can be spaced from emission surfaces of solid state light emitters that are not in contact with the light mixing element.

In some embodiments in accordance with the present inventive subject matter, which can include or not include, as suitable, any of the other features described herein, a light mixing element can comprise two or more light mixing element regions. To provide a representative example, a light mixing element can comprise (1) a first light mixing element region in the form of a first solid light transmissive structure that is hemispherical in shape and in which the "flat" side serves as an entrance region through which light from solid state light emitters enters the light mixing element, and (2) a second light mixing element region in the form of a second light transmissive structure that covers all of the curved surface of the hemispherical structure except for a region that is farthest from the flat side, and the second light transmissive structure can provide an enhanced degree of reflection at the interface between the first and second regions of the light mixing element and/or within its depth, thereby enhancing the degree to which the region of the hemispherical structure that is farthest from the flat side functions as an exit region (by reducing the extent to which light exits through other portions of the surface of the light mixing element). As another representative example, a light mixing element can comprise (1) a first light mixing element region in the form of a first solid light transmissive structure of any suitable shape, and (2) a partially reflective coating, layer and/or structure covering at least a portion of the surface of the first solid light transmissive structure.

The size of the light mixing element (or light mixing elements) can be any suitable size. In some embodiments in accordance with the present inventive subject matter, which can include or not include, as suitable, any of the other features described herein, a largest dimension of the first light mixing element is not larger than 16 mm (and in some embodiments, not larger than 15 mm, not larger than 14 mm, not larger than 13 mm, not larger than 12 mm, not larger than 11 mm, not larger than 10 mm, not larger than 9 mm, not larger than 8 mm, not larger than 7 mm, not larger than 6 mm, not larger than 5 mm, not larger than 4 mm, not larger than 3 mm, not larger than 2 mm, or not larger than 1 mm).

In some embodiments in accordance with the present inventive subject matter, which can include or not include, as suitable, any of the other features described herein, at least about 80 percent (and in some embodiments, at least about 85 percent, at least about 90 percent, at least about 92 percent, at least about 94 percent or at least about 95 percent) of a total amount of light emitted by the first, second, third, fourth and fifth solid state light emitters enters an entrance region of the first light mixing element, and/or at least about 70 percent (and in some embodiments, at least about 75 percent, at least about 80 percent, at least about 85 percent or at least about 90 percent) of a total amount of light emitted by the first, second, third, fourth and fifth solid state light emitters that enters the first light mixing element exits from an exit region of the first light mixing element.

In some embodiments in accordance with the present inventive subject matter, which can include or not include, as suitable, any of the other features described herein, the exit region of the first light mixing element has a surface area between about 50% to about 300% of the surface area of the entrance region, and in some embodiments in accordance with the present inventive subject matter, which can include or not include, as suitable, any of the other features described herein, the exit region of the first light mixing element has a surface area between about 60% to about 250%, between about 70% to about 200%, between about 80% to about 150%, between about 90% to about 125%, between about 95% to about 110%, between about 50% to about 75%, between about 75% to about 100%, between about 100% to about 125%, between about 125% to about 150%, between about 150% to about 175%, between about 175% to about 200%, between about 200% to about 225%, between about 225% to about 250%, between about 250% to about 275%, or between about 275% to about 300% of the surface area of the entrance region.

In some embodiments in accordance with the present inventive subject matter, which can include or not include, as suitable, any of the other features described herein, the exit region of the first light mixing element has a surface area of not greater than 400 square millimeters.

In some instances, the entrance region is considered to be a region of the smallest surface area on an external surface (of a light mixing element), which region has a perimeter that has no inflection points and through which at least about 80 percent (or at least about 85 percent, or at least about 90 percent, or at least about 92 percent, or at least about 94 percent, or at least about 95 percent) of the total amount of light emitted by the solid state light emitters enters the light mixing element.

In some instances, the entrance region is considered to be a region of the smallest surface area on an external surface (of a light mixing element), which region has a perimeter that has no inflection points and through which at least about 70 percent (or at least about 75 percent, or at least about 80 percent, or at least about 85 percent, or at least about 90 percent) of the total amount of light emitted by the solid state light emitters that enters the light mixing element exits the light mixing element.

As noted above, in some embodiments in accordance with the present inventive subject matter, which can include or not include, as suitable, any of the other features described herein, light exiting from a light mixing element has good uniformity of color hue. The expression "good uniformity of color hue", as used herein, can indicate that when solid state light emitters are emitting light, each of at least 50 (and in some instances 100, 200, 300, 500 or 1,000) non-overlapping conceptual square regions of approximately equal size (not physically defined, but instead defined by imaginary lines) of the exit region of a light mixing element have a color hue that is within 0.01 unit of a first color point on a 1976 CIE Chromaticity Diagram (each of the non-overlapping square regions comprising a corresponding percentage of a total surface area of the exit region, e.g., each of 50 square regions comprising 1/50 of the total surface area, or each of 100 square regions comprising 1/100 of the total surface area, or each of 500 square regions comprising 1/500 of the total surface area, etc.). In some situations, "good uniformity of color hue" (and/or "good uniformity of emitted light color") can be assessed based on whether or not the color hue uniformity requirements of the L Prize are met. In some situations, "good uniformity of color hue" (and/or "good uniformity of emitted light color") can mean that there is less than 500 K CCT variation over the surface of the light mixing element (or over the exit region of the light mixing element).

As noted above, in some embodiments in accordance with the present inventive subject matter, there are provided lighting devices that comprise at least one light output shaping element.

Persons of skill in the art are familiar with, have access to, and can readily make, a wide variety of light output shaping elements. A representative example of a suitable light output shaping element is a reflector, e.g., a reflective surface in any suitable shape, e.g., a hollow frustoconical shape. Another representative example of a suitable light output shaping element is a lens, e.g., a light transmissive material in any suitable shape, e.g., a disc having a flat surface on one side and a convex surface on a second side, a disc having a concave surface on one side and a convex surface on a second side, any of a variety of readily available TIR lenses, etc. A light output shaping element (if included) can comprise one or more light transmissive regions or elements and/or one or more reflective regions or elements).

In some embodiments according to the present inventive subject matter that comprise a light output shaping element, at least some light emitted by solid state light emitters enters a light mixing element, then exits the light mixing element into the light output shaping element, and then exits the lighting device.

In some embodiments according to the present inventive subject matter that comprise a light output shaping element, the light output shaping element defines an exit aperture having a dimension that is at least six (and in some embodiments, at least ten, or at least twelve, or at least fourteen, or at least sixteen) times a largest dimension of the light mixing element, and/or having a surface area that is of any suitable size, e.g., between one and three inches across (e.g., in diameter).

In embodiments according to the present inventive subject matter that comprise one or more light output shaping elements, a light output shaping element can be made of any suitable material or materials, a wide variety of which are well known to those of skill in the art. For instance, representative examples include any of a wide variety of light transmissive materials (e.g., glass, plastic, SiC, polycarbonate, etc.), and any of a wide variety of reflective materials (e.g., aluminum, plastic, ceramic or glass, any of which can, if desired, be coated with any suitable material, e.g., silver, aluminum, etc.). In embodiments in which one or more materials is/are coated, applied, laminated, mounted, etc. onto another material or materials, such coating, applying, laminating, mounting, etc, can be carried out in any suitable way (e.g., by vacuum metallization, etc.).

In embodiments according to the present inventive subject matter that comprise one or more light output shaping elements, a light output shaping element can have any of a wide range of surface and/or internal structures to assist in heat dissipation, as is well known in the art, e.g., an external surface that faces away from the majority of the light emitted it can be textured, can have grooves, can be faceted, can be painted, etc. (or it can be smooth).

In some embodiments in accordance with the present inventive subject matter, which can include or not include, as suitable, any of the other features described herein, a brightness of light emitted by the plurality of solid state light emitters exiting the first light mixing element is at least about 500 lumens (and in some embodiments, at least about 600 lumens, at least about 700 lumens, at least about 800 lumens, at least about 900 lumens, at least about 1,000 lumens, at least about 1,200 lumens, at least about 1,500 lumens, at least about 2,000 lumens, at least about 3,000 lumens, at least about 4,000 lumens, or at least about 5,000 lumens.

In some embodiments in accordance with the present inventive subject matter, which can include or not include, as suitable, any of the other features described herein, the lighting device can further comprise a housing. The housing (if included) can generally be of any suitable shape and size, and can be made out of any suitable material or materials. Representative examples of materials that can be used in making a housing include, among a wide variety of other materials, extruded aluminum, powder metallurgy formed aluminum, die cast aluminum, liquid crystal polymer, polyphenylene sulfide (PPS), thermoset bulk molded compound or other composite material. In some embodiments in accordance with the present inventive subject matter, which can include or not include, as suitable, any of the other features described herein, a housing (if included) can comprise a material that can be molded and/or shaped, and/or it can comprise a material that is an effective heat sink (i.e., which has high thermal conductivity and/or high heat capacity).

In some embodiments in accordance with the present inventive subject matter, which can include or not include, as suitable, any of the other features described herein, the lighting device can further comprise a fixture. A fixture (if included) can generally be of any suitable shape and size, and can be made out of any suitable material or materials. Representative examples of materials that can be used in making a housing include, among a wide variety of other materials, extruded aluminum, powder metallurgy formed aluminum, die cast aluminum, liquid crystal polymer, polyphenylene sulfide (PPS), thermoset bulk molded compound or other composite material. In some embodiments in accordance with the present inventive subject matter, which can include or not include, as suitable, any of the other features described herein, a housing (if included) can comprise a material that can be molded and/or shaped, and/or it can comprise a material that is an effective heat sink (i.e., which has high thermal conductivity and/or high heat capacity).

In some embodiments in which a fixture is included, one or more components of the lighting device can be attached to and/or supported by the fixture. For example, in some embodiments that include a fixture and a housing, the housing can be attached to and/or supported by the fixture, e.g., the housing can be mounted in the fixture pivotably and/or swivelably (whereby the direction of the beam of light exiting from the lighting device can be selected, altered and/or affected).

In some embodiments in which a fixture and/or a housing is included, the fixture and/or the housing can define an exit aperture through which light exiting the lighting device passes. For example, in some embodiments in which a fixture is included, the fixture can include a pinhole plate that defines an exit aperture (in such embodiments, a light output shaping element can be included which has an exit aperture that is of a size and shape that corresponds to the size and shape of the exit aperture in the pinhole plate, and/or the interior surface of the pinhole plate can be reflective so that at least some light blocked by the pinhole plate is reflected back into the light output shaping element and eventually exits through the exit aperture in the pinhole plate).

In some embodiments in which a fixture is included, the fixture can include structure and/or one or more elements to assist in mounting the lighting device, e.g., a fixture can include one or more clamps and/or a mounting ring, etc. (e.g., the mounting ring and clips can engage opposite sides of a construction structure such as sheetrock and clamp the construction structure to hold the lighting device in place.

In some embodiments in accordance with the present inventive subject matter, which can include or not include, as suitable, any of the other features described herein, the lighting device can further comprise a power supply and/or one or more controls (e.g., one or more current regulators, one or more color balance control components, one or more dimming control components), a wide variety of which (and a wide variety of combinations of which) are well known to persons skilled in the art, and any one which (or any combination of which) can be employed in the lighting devices according to the present inventive subject matter.

In embodiments that include a housing and a power supply (and/or one or more components thereof) and/or one or more controls (and/or one or more components thereof), any or all of the power supply and/or the controls (or any component or components thereof) can be inside or outside the housing. In such embodiments, positioning any or all of the power supply and/or the controls (or any component or components thereof) outside the housing can help to reduce the thermal load within the housing.

In some embodiments in accordance with the present inventive subject matter that comprise a power supply, a power supply can comprise any electronic components that are suitable for a lighting device, for example, any of (1) one or more electrical components employed in converting electrical power (e.g., from AC to DC and/or from one voltage to another voltage), (2) one or more electronic components employed in driving one or more solid state light emitters, e.g., running one or more solid state light emitters intermittently and/or adjusting the current supplied to one or more solid state light emitters in response to a user command, a detected change in intensity or color of light output, a detected change in an ambient characteristic such as temperature (e.g., a compensation circuit) or background light, etc., and/or a signal contained in the input power (e.g., a dimming signal in AC power supplied to the lighting device), etc., (3) one or more circuit boards (e.g., a metal core circuit board) for supporting and/or providing current to any electrical components, and/or (4) one or more wires connecting any components (e.g., connecting an Edison socket to a circuit board), etc., e.g. electronic components such as linear current regulated supplies, pulse width modulated current and/or voltage regulated supplies, bridge rectifiers, transformers, power factor controllers etc.

In some embodiments in accordance with the present inventive subject matter, which can include or not include, as suitable, any of the other features described herein, the lighting device can further comprise an electrical connector. Various types of electrical connectors are well known to those skilled in the art, and any of such electrical connectors can be attached within (or attached to) the lighting devices according to the present inventive subject matter. Representative examples of suitable types of electrical connectors include wires (for splicing to a branch circuit), Edison plugs (which are receivable in Edison sockets) and GU24 pins (which are receivable in GU24 sockets). Other well known types of electrical connectors include 2-pin (round) GX5.3, can DC bay, 2-pin GY6.35, recessed single contact R7s, screw terminals, 4 inch leads, 1 inch ribbon leads, 6 inch flex leads, 2-pin GU4, 2-pin GU5.3, 2-pin G4, turn & lock GU7, GU10, G8, G9, 2-pin Pf, min screw E10, DC bay BA15d, min cand E11, med screw E26, mog screw E39, mogul bipost G38, ext. mog end pr GX16d, mod end pr GX16d and med skirted E26/50x39 (see https://www.gecatalogs.com/lighting/software/GELightingCatalogSetup.exe).

In some embodiments in accordance with the present inventive subject matter, which can include or not include, as suitable, any of the other features described herein, some or all of the solid state light emitters in the lighting device can be on one or more circuit boards, a wide variety of which are well known, readily available and able to be made by persons of skill in the art. A representative example of a suitable circuit board (when employed) for use in the lighting devices according to the present inventive subject matter is a metal core printed circuit board.

In some embodiments in accordance with the present inventive subject matter, which can include or not include, as suitable, any of the other features described herein, any of a wide variety of thermal dissipation features can be provided. For example, in some embodiments in accordance with the present inventive subject matter, which can include or not include, as suitable, any of the other features described herein, a light output shaping element and/or a housing can be thermally coupled to the solid state light emitters, and/or (as discussed above) there can be provided a light output shaping element that conducts heat effectively (e.g., it is formed of aluminum) and/or that has high heat capacity, and/or that has one or more surfaces that is/are textured, that has/have grooves, that is/are faceted, that has one or more fins, that is/are painted, etc., and/or there can be provided a housing that conducts heat effectively (e.g., it is formed of aluminum) and/or that has high heat capacity, and/or that has one or more surfaces that is/are textured, that has/have grooves, that is/are faceted, that has one or more fins, that is/are painted, etc., and/or there can be provided one or more thermal connector regions (such as a graphite sheet or graphite foam member), a variety of which are known to those of skill in the art.

Some embodiments of lighting devices according to the present inventive subject matter have only passive cooling. On the other hand, some embodiments of lighting devices according to the present inventive subject matter can have active cooling (and can optionally also have passive cooling features). The expression "active cooling" is used herein in a manner that is consistent with its common usage to refer to cooling that is achieved through the use of some form of energy, as opposed to "passive cooling", which is achieved without the use of energy (i.e., while energy is supplied to the solid state light emitters, passive cooling is the cooling that would be achieved without the use of any component(s) that would require additional energy in order to function to provide additional cooling).

Lighting devices according to the present inventive subject matter can provide a beam of light that has a variety of desired properties, e.g., an intensity full width half max (FWHM) of between 8 and 60 degrees with exceptional cutoff, e.g., greater than 60% (or greater than 70%, greater than 80%, greater than 85%, or greater than 90%) of total flux within the FWHM, and therefore very low glare.

The overall size of the lighting devices can be any suitable size, depending on the particular application. For example, some embodiments are comparable in size with MR16 lighting devices, while other embodiments can be much larger (e.g., for use as spotlights or in lighthouses).

Energy can be supplied to the lighting device from any source or combination of sources, for example, the grid (e.g., line voltage), one or more batteries, one or more photovoltaic energy collection devices (i.e., a device that includes one or more photovoltaic cells that convert energy from the sun into electrical energy), one or more windmills, etc.

In some embodiments according to the present inventive subject matter, including some embodiments that include or do not include any of the features as discussed herein, the lighting device has a wall plug efficiency of at least about 25 lumens per watt, in some cases at least about 35 lumens per watt, in some cases at least about 50 lumens per watt, in some cases at least about 60 lumens per watt, in some cases at least about 70 lumens per watt, and in some cases at least about 80 lumens per watt, and in some cases at least about 90 lumens per watt, and in some cases at least about 100 lumens per watt, and in some cases at least about 110 lumens per watt, and in some cases at least about 120 lumens per watt.

The expression "wall plug efficiency", as used herein, is measured in lumens per watt, and means lumens exiting a lighting device, divided by all energy supplied to create the light, as opposed to values for individual components and/or assemblies of components. Accordingly, wall plug efficiency, as used herein, accounts for all losses, including, among others, any quantum losses, i.e., losses generated in converting line voltage into current supplied to light emitters, the ratio of the number of photons emitted by luminescent material(s) divided by the number of photons absorbed by the luminescent material(s), any Stokes losses, i.e., losses due to the change in frequency involved in the absorption of light and the re-emission of visible light (e.g., by luminescent material(s)), and any optical losses involved in the light emitted by a component of the lighting device actually exiting the lighting device. In some embodiments, the lighting devices in accordance with the present inventive subject matter provide the wall plug efficiencies specified herein when they are supplied with AC power (i.e., where the AC power is converted to DC power before being supplied to some or all components, the lighting device also experiences losses from such conversion), e.g., AC line voltage. The expression "line voltage" is used in accordance with its well known usage to refer to electricity supplied by an energy source, e.g., electricity supplied from a grid, including AC and DC.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross sections may be rotated around a central axis to provide lighting devices that are circular in nature. Alternatively, the cross sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

Figure 1:
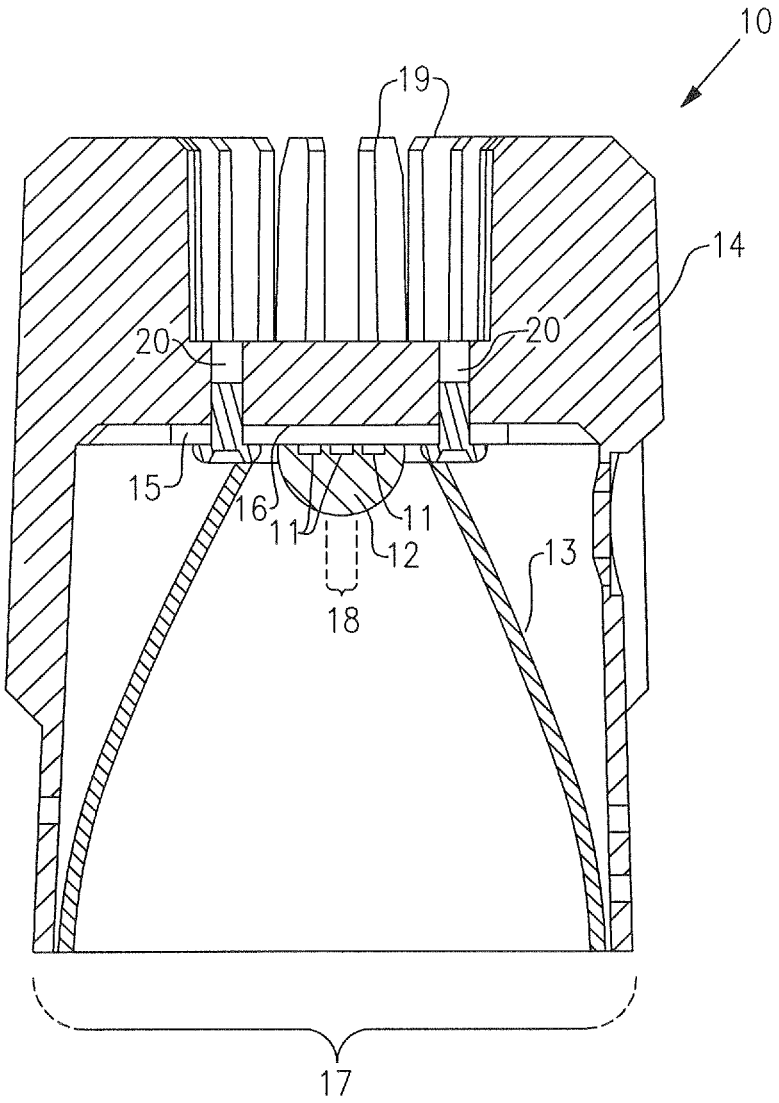
FIG. 1 is a sectional view of a lighting device according to the present inventive subject matter

FIG. 1 is a sectional view of a lighting device according to the present inventive subject matter. FIG. 1 depicts a lighting device 10 that comprises solid state light emitters 11, a light mixing element 12, a light output shaping element 13, a housing 14, a circuit board 15 and a graphite sheet 16. The light mixing element 12 has an entrance region (where the light mixing element 12 is in contact with the solid state light emitters 11) and an exit region 18. The light output shaping element 13 defines an exit aperture 17. The housing 14 includes fins 19. FIG. 1 also shows conduits 20 through which wires or other electrical connectors can be fed (e.g., to connect a power supply positioned in a space surrounded by the upper portions of the fins 19 to the circuit board 15). At least 10 percent of light emitted by the solid state light emitters 11 that enters the light mixing element 12 is reflected at least once within the light mixing element 12, by being reflected at an external surface of the light mixing element 12.

Figure 2:
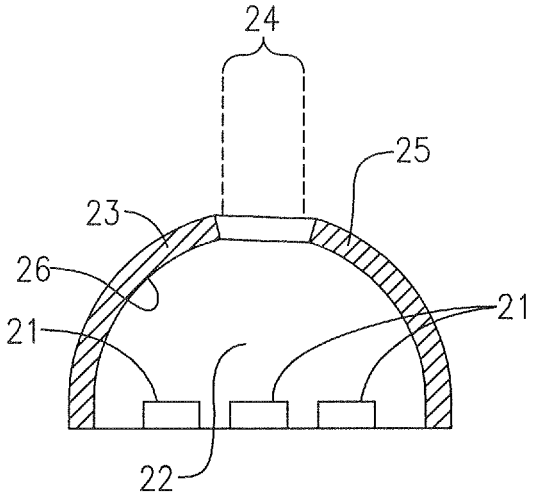
FIG. 2 is a sectional view of a portion of a lighting device.

FIG. 2 is a sectional view of a portion of a lighting device that is similar to the lighting device depicted in FIG. 1, except that the lighting device (a portion of which is depicted in FIG. 2) comprises a light mixing element (in contact with solid state light emitters 21) that has a first region 22 and a second region 23, and an exit region 24 (which is the portion of the curved surface of the first region 22 that is not covered by the second region 23). At least 10 percent of light emitted by the solid state light emitters 21 that enters the first region 22 of the light mixing element is reflected at least once within the light mixing element, by being reflected at an interface 25 between the first region 22 of the light mixing element and the second region 23 of the light mixing element, and/or by being reflected at a surface 26 of the second region 23 of the light mixing element.

Figure 3:
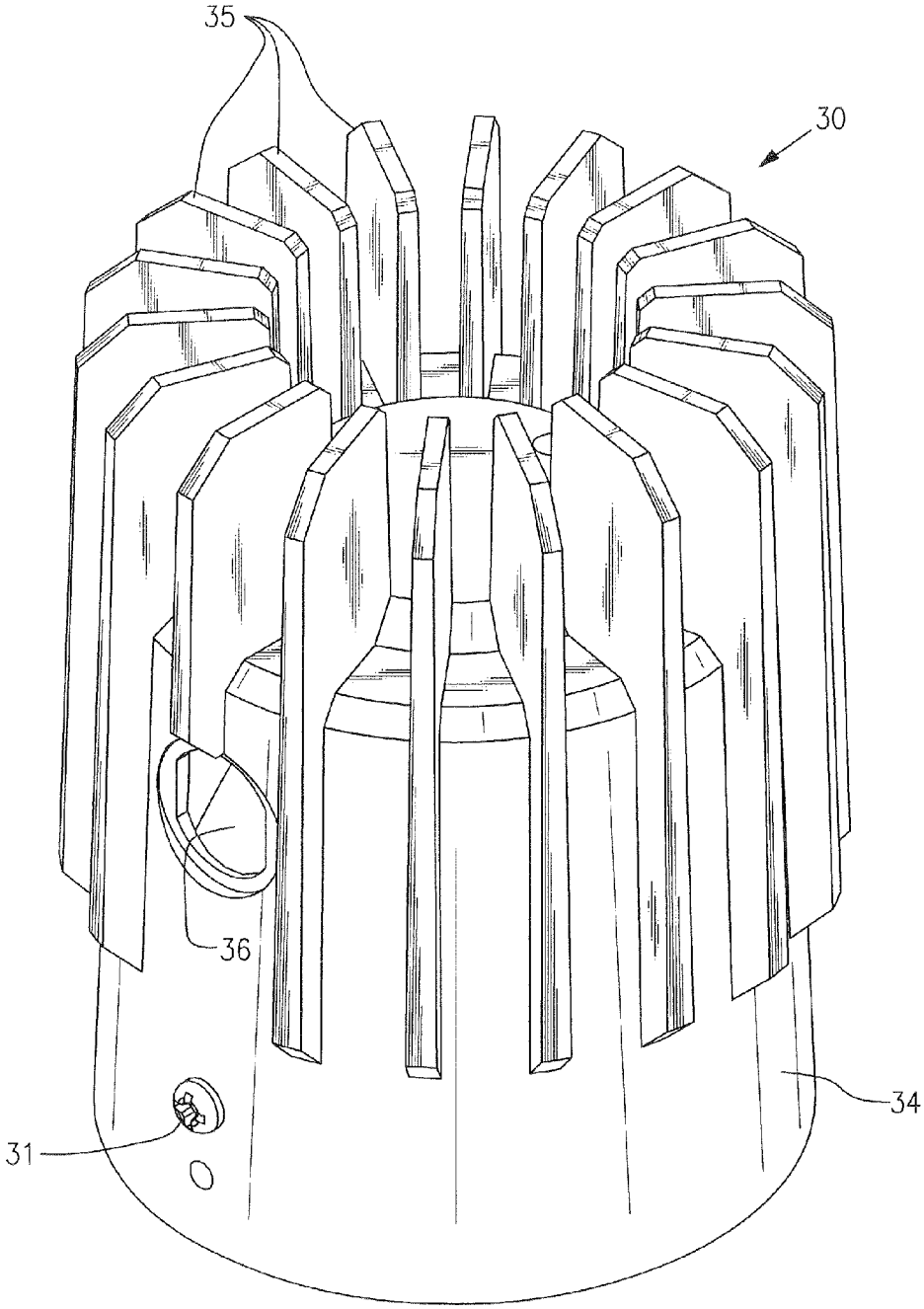
FIGS. 3 and 4 are perspective views of a lighting device 30.
Figure 4:
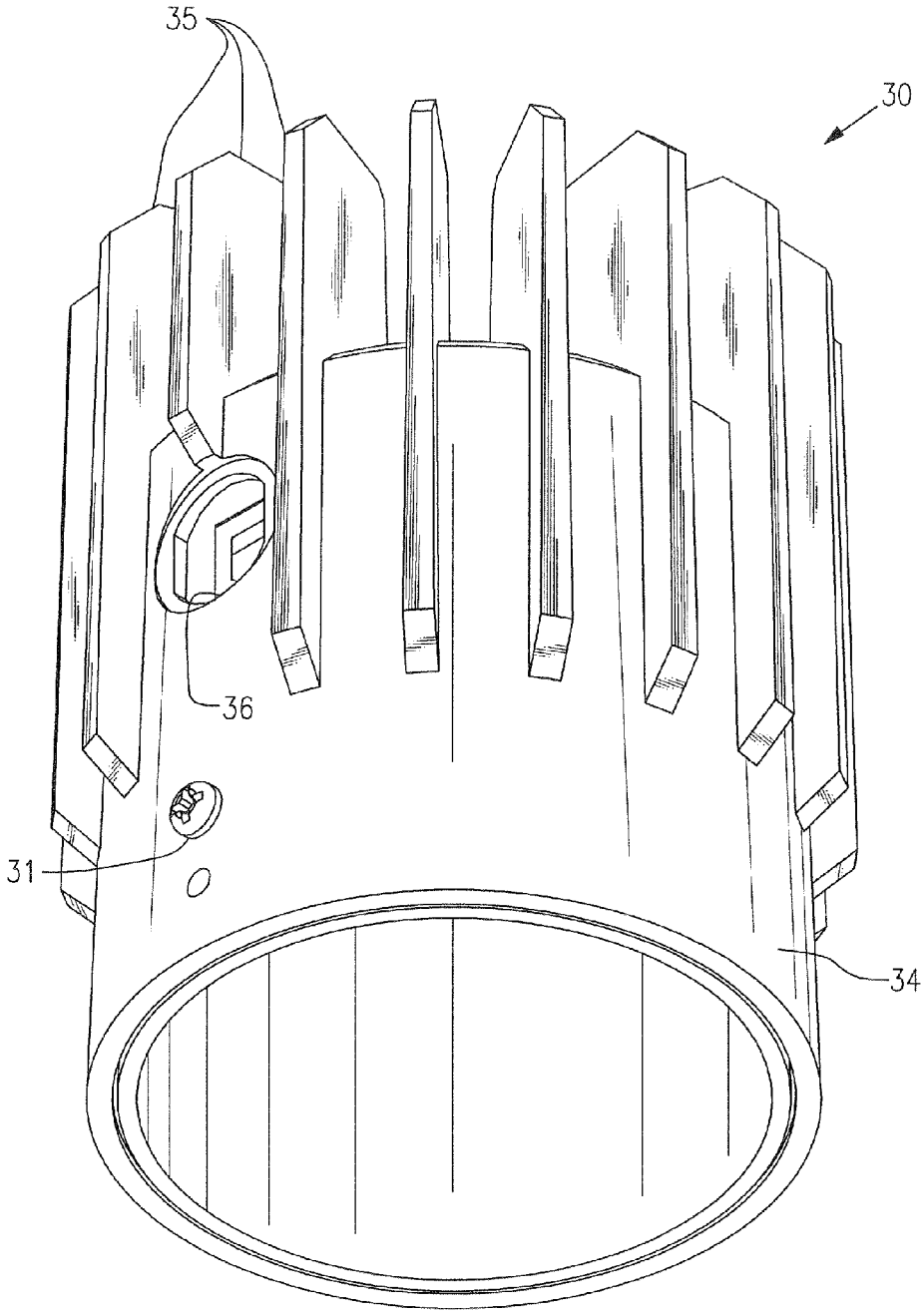

FIGS. 3 and 4 are perspective views of a lighting device 30 that is similar to the lighting device 10, except that the lighting device 30 has pivot points 31 (only one is visible in FIGS. 3 and 4—the other one is on the opposite side of the housing 34, i.e., a 180 degree rotation of the lighting device 30 about its axis away from the one that is visible). In FIGS. 3 and 4, fins 35 on the housing 34 are visible, as is an aperture 36 through which electrical connectors can be fed into the housing 34. The pivot points 31 can be receivable in corresponding receptacles in a fixture, whereby the lighting device 30 can be pivotable within the fixture.

FIGS. 5 and 6 are perspective views showing the lighting device 30 mounted in a fixture 50 that has a mounting ring 51 and receptacles 52 (only one is visible in FIG. 5) for receiving the pivot points 31.

FIG. 7 is a perspective view showing the lighting device 30 mounted in a fixture 70 which is similar to the fixture 50, except that the fixture 70 has a mounting ring that has a pinhole plate 71.

FIGS. 8 and 9 are perspective views showing the lighting device 30 mounted in a fixture 80 that has three mounting clips 81 (only two are visible in FIG. 8—they are spaced evenly relative to the axis of the lighting device 30).

FIG. 10 is a sectional view of a lighting device according to the present inventive subject matter that is similar to the lighting device 10 depicted in FIG. 1, except that the lighting device 100 depicted in FIG. 10 comprises a light mixing element that comprises a first region 103 and a second region 104.

FIG. 11 is a sectional view of a portion of a lighting device that is similar to the lighting device depicted in FIG. 1, except that the lighting device (a portion of which is depicted in FIG. 11) comprises a light mixing element (above solid state light emitters 111) that is a hollow structure 112 that has highly reflective surfaces and an aperture 113 that serves as an exit region.

FIG. 12 is a perspective view showing a pair of lighting devices 30 mounted in a fixture 120 which is generally rectangular-boxed shaped, and that includes a pair of generally square-shaped openings 121, with each lighting device 30 located so that light emitted therefrom exits the fixture 120 through a respective opening 121.

FIG. 13 is a perspective view showing a lighting device 30 mounted in a fixture 120 which is generally square-boxed shaped, and that includes a generally square-shaped opening 131, with the lighting device 30 located so that light emitted therefrom exits the fixture 130 through the opening 131.

While certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Below are a series of numbered passages, each of which defines subject matter within the scope of the present inventive subject matter:

Passage 1. A lighting device, comprising:

at least a first solid state light emitter; and at least a first light mixing element, at least some light emitted by the first solid state light emitter entering the first light mixing element and then exiting the first light mixing element, at least 10 percent of light emitted by the first solid state light emitter that enters the first light mixing element is reflected at least once within the first light mixing element, and a largest dimension of the first light mixing element is not larger than 16 mm.

Passage 2. A lighting device as recited in passage 1, wherein:

at least some of the light that is reflected at least once within the first light mixing element is reflected:

(1) at an external surface of the first light mixing element;

(2) at an interface between a first region of the first light mixing element and a second region of the first light mixing element; and/or (3) at a surface of a second region of the first light mixing element.

Passage 3. A lighting device as recited in passage 1 or passage 2, wherein:

at least 80 percent of a total amount of light emitted by the first solid state light emitter enters an entrance region of the first light mixing element, at least 70 percent of a total amount of light emitted by the first solid state light emitter that enters the first light mixing element exits from an exit region of the first light mixing element, the exit region of the first light mixing element has a surface area between about 50% to about 300% of the surface area of the entrance region.

Passage 4. A lighting device as recited in passage 3, wherein the entrance region is a minimum surface area region on an external surface of the first light mixing element that has a perimeter that has no inflection points and through which at least 80 percent of the total amount of light emitted by the first solid state light emitter enters.

Passage 5. A lighting device as recited in passage 3, wherein the exit region is a minimum surface area region on an external surface of the first light mixing element that has a perimeter that has no inflection points and through which at least 70 percent of the total amount of light emitted by the first solid state light emitter that enters the first light mixing element exits.

Passage 6. A lighting device as recited in any one of passages 1-5, wherein the lighting device further comprises at least a first light output shaping element, and at least some light emitted by the first solid state light emitter enters the first light mixing element, then exits the first light mixing element into the first light output shaping element, and then exits the lighting device.

Passage 7. A lighting device as recited in any one of passages 1-6, wherein:

at least 80 percent of a total amount of light emitted by the first solid state light emitter enters an entrance region of the first light mixing element, at least 70 percent of a total amount of light emitted by the first solid state light emitter that enters the first light mixing element exits from an exit region of the first light mixing element, and the lighting device further comprises at least a first light output shaping element that defines an exit aperture having a surface area that is at least eight times the surface area of the exit region of the first light mixing element.

Passage 8. A lighting device as recited in any one of passages 1-6, wherein:

at least 80 percent of a total amount of light emitted by the first solid state light emitter enters an entrance region of the first light mixing element, at least 70 percent of a total amount of light emitted by the first solid state light emitter that enters the first light mixing element exits from an exit region of the first light mixing element, and the lighting device further comprises at least a first light output shaping element that defines an exit aperture having a surface area that is at least sixteen times the surface area of the exit region of the first light mixing element.

Passage 9. A lighting device as recited in any one of passages 1-8, wherein the first light mixing element comprises at least a first mixing element region and a second mixing element region.

Passage 10. A lighting device as recited in passage 9, wherein:

the first mixing element region comprises a first structure, the second mixing element region comprises a second structure, the first structure is solid and light transmissive, and the second structure is reflective.

Passage 11. A lighting device as recited in passage 10, wherein:

the second structure comprises at least a first aperture, and the second structure covers a portion of an outer substantially hemispherical surface of the first structure, except for an exit region of the first structure that is exposed to the aperture.

Passage 12. A lighting device as recited in passage 11, wherein the exit region of the first structure includes a point through which an axis of the outer substantially hemispherical surface extends.

Passage 13. A lighting device as recited in passage 11 or passage 12, wherein the exit region of the first structure has a surface area that is not more than 25% of a surface area of the outer substantially hemispherical surface.

Passage 14. A lighting device as recited in any one of passages 1-13, wherein:

at least 80 percent of a total amount of light emitted by the first solid state light emitter enters an entrance region of the first light mixing element, at least 70 percent of a total amount of light emitted by the first solid state light emitter that enters the first light mixing element exits from an exit region of the first light mixing element, and the exit region of the first light mixing element has a surface area of not greater than 403 square millimeters.

Passage 15. A lighting device as recited in any one of passages 1-14, wherein at least 20 percent of light emitted by the first solid state light emitter that enters the first light mixing element is reflected at least once within the first light mixing element.

Passage 16. A lighting device as recited in any one of passages 1-15, wherein a brightness of light exiting the first light mixing element is at least 500 lumens Passage 17. A lighting device as recited in any one of passages 1-16, wherein the lighting device comprises at least second, third, fourth and fifth solid state light emitters in addition to the first solid state light emitter.

Passage 18. A lighting device as recited in passage 17, wherein the lighting device comprises a plurality of solid state light emitters including the first, second, third, fourth and fifth solid state light emitters, and a brightness of light emitted by the plurality of solid state light emitters exiting the first light mixing element is at least 500 lumens.

Passage 19. A lighting device as recited in passage 17 or passage 18, wherein at least 20 percent of light emitted by the first, second, third, fourth and fifth solid state light emitters that enters the first light mixing element is reflected at least once within the first light mixing element.

Passage 20. A lighting device as recited in any one of passages 17-19, wherein:

the first solid state light emitter is configured to emit light within a first region on a 1976 CIE Chromaticity Diagram, the second solid state light emitter is configured to emit light within a second region on a 1976 CIE Chromaticity Diagram, each point within the first region is spaced from each point within the second region by at least 0.01 u', v' units on a 1976 CIE Chromaticity Diagram.

Passage 21. A lighting device as recited in any one of passages 17-20, wherein:

at least some light emitted by each of the first, second, third, fourth and fifth solid state light emitters enters the first light mixing element and then exits the first light mixing element, at least 10 percent of light emitted by the first, second, third, fourth and fifth solid state light emitters that enters the first light mixing element is reflected at least once within the first light mixing element.

Passage 22. A lighting device as recited in any one of passages 17-21, wherein:

at least 80 percent of a total amount of light emitted by the first, second, third, fourth and fifth solid state light emitters enters an entrance region of the first light mixing element, at least 70 percent of a total amount of light emitted by the first, second, third, fourth and fifth solid state light emitters that enters the first light mixing element exits from an exit region of the first light mixing element, the exit region of the first light mixing element has a surface area between about 50% to about 300% of the surface area of the entrance region.

Passage 23. A lighting device as recited in passage 22, wherein the entrance region is a minimum surface area region on an external surface of the first light mixing element that has a perimeter that has no inflection points and through which at least 80 percent of the total amount of light emitted by the first, second, third, fourth and fifth solid state light emitters enters.

Passage 24. A lighting device as recited in passage 22 or passage 23, wherein the exit region is a minimum surface area region on an external surface of the first light mixing element that has a perimeter that has no inflection points and through which at least 70 percent of the total amount of light emitted by the first, second, third, fourth and fifth solid state light emitters that enters the first light mixing element exits.

Passage 25. A lighting device as recited in any one of passages 17-24, wherein the lighting device further comprises at least a first light output shaping element, and at least some light emitted by the first, second, third, fourth and fifth solid state light emitters enters the first light mixing element, then exits the first light mixing element into the first light output shaping element, and then exits the lighting device.

Passage 26. A lighting device, comprising:

at least a first solid state light emitter; and at least a first light mixing element, the first light mixing element comprising at least a first mixing element region and a second mixing element region, at least some light emitted by the first solid state light emitter entering the first light mixing element and then exiting the first light mixing element, a largest dimension of the first light mixing element is not larger than 16 mm.

Passage 27. A lighting device as recited in passage 26, wherein:

the first mixing element region comprises a first structure, the second mixing element region comprises a second structure, the first structure is solid and light transmissive, and the second structure is reflective.

Passage 28. A lighting device as recited in passage 27, wherein:

the second structure comprises at least a first aperture, and the second structure covers a portion of an outer substantially hemispherical surface of the first structure, except for an exit region of the first structure that is exposed to the aperture.

Passage 29. A lighting device as recited in passage 28, wherein the exit region of the first structure includes a point through which an axis of the outer substantially hemispherical surface extends.

Passage 30. A lighting device as recited in passage 28 or passage 29, wherein the exit region of the first structure has a surface area that is not more than 25% of a surface area of the outer substantially hemispherical surface.

Passage 31. A lighting device as recited in any one of passages 26-30, wherein at least 10 percent of light emitted by the first solid state light emitter that enters the first light mixing element is reflected at least once within the first light mixing element.

Passage 32. A lighting device as recited in passage 31, wherein:

at least some of the light that is reflected at least once within the first light mixing element is reflected:

(1) at an external surface of the first light mixing element;

(2) at an interface between the first region of the first light mixing element and the second region of the first light mixing element; and/or (3) at a surface of the second region of the first light mixing element.

Passage 33. A lighting device as recited in any one of passages 26-32, wherein:

at least 80 percent of a total amount of light emitted by the first solid state light emitter enters an entrance region of the first light mixing element, at least 70 percent of a total amount of light emitted by the first solid state light emitter that enters the first light mixing element exits from an exit region of the first light mixing element, the exit region of the first light mixing element has a surface area between about 50% to about 300% of the surface area of the entrance region.

Passage 34. A lighting device as recited in any one of passages 26-33, wherein the lighting device further comprises at least a first light output shaping element, and at least some light emitted by the first solid state light emitter enters the first light mixing element, then exits the first light mixing element into the first light output shaping element, and then exits the lighting device.

Passage 35. A lighting device as recited in any one of passages 26-34, wherein a brightness of light exiting the first light mixing element is at least 500 lumens Passage 36. A lighting device as recited in any one of passages 26-35, wherein the lighting device comprises at least second, third, fourth and fifth solid state light emitters in addition to the first solid state light emitter.

Passage 37. A lighting device as recited in passage 36, wherein the lighting device comprises a plurality of solid state light emitters including the first, second, third, fourth and fifth solid state light emitters, and a brightness of light emitted by the plurality of solid state light emitters exiting the first light mixing element is at least 500 lumens.

Passage 38. A lighting device as recited in passage 36 or passage 37, wherein at least 20 percent of light emitted by the first, second, third, fourth and fifth solid state light emitters that enters the first light mixing element is reflected at least once within the first light mixing element.

Passage 39. A lighting device as recited in any one of passages 36-38, wherein:

the first solid state light emitter is configured to emit light within a first region on a 1976 CIE Chromaticity Diagram, the second solid state light emitter is configured to emit light within a second region on a 1976 CIE Chromaticity Diagram, each point within the first region is spaced from each point within the second region by at least 0.01 u', v' units on a 1976 CIE Chromaticity Diagram.

Passage 40. A lighting device, comprising:

at least a first solid state light emitter; and at least a first light mixing element, at least 80 percent of a total amount of light emitted by the first solid state light emitter entering an entrance region of the first light mixing element, at least 10 percent of light emitted by the first solid state light emitter that enters the first light mixing element is reflected at least once within the first light mixing element, at least 70 percent of a total amount of light emitted by the first solid state light emitter that enters the first light mixing element exiting from an exit region of the first light mixing element, and the exit region of the first light mixing element having a surface area between about 50% to about 300% of the surface area of the entrance region.

Passage 41. A lighting device as recited in passage 40, wherein the entrance region is a minimum surface area region on an external surface of the first light mixing element that has a perimeter that has no inflection points and through which at least 80 percent of the total amount of light emitted by the first solid state light emitter enters.

Passage 42. A lighting device as recited in passage 40 or passage 41, wherein the exit region is a minimum surface area region on an external surface of the first light mixing element that has a perimeter that has no inflection points and through which at least 70 percent of the total amount of light emitted by the first solid state light emitter that enters the first light mixing element exits.

Passage 43. A lighting device as recited in any one of passages 40-42, wherein the lighting device further comprises at least a first light output shaping element, and at least some light emitted by the first solid state light emitter enters the first light mixing element, then exits the first light mixing element into the first light output shaping element, and then exits the lighting device.

Passage 44. A lighting device as recited in passage 43, wherein the first light output shaping element defines an exit aperture having a surface area that is at least eight times the surface area of the exit region of the first light mixing element.

Passage 45. A lighting device as recited in passage 43, wherein the first light output shaping element defines an exit aperture having a surface area that is at least sixteen times the surface area of the exit region of the first light mixing element.

Passage 46. A lighting device as recited in any one of passages 40-45, wherein the lighting device comprises at least second, third, fourth and fifth solid state light emitters in addition to the first solid state light emitter.

Passage 47. A lighting device, comprising:

at least a first solid state light emitter;

at least a first light mixing element; and at least a first light output shaping element, at least 10 percent of light emitted by the first solid state light emitter that enters the first light mixing element is reflected at least once within the first light mixing element, at least some light emitted by the first solid state light emitter entering the first light mixing element, then exiting the first light mixing element into the first light output shaping element, and then exiting the lighting device, and the first light output shaping element defining an exit aperture having a dimension that is at least three times a largest dimension of the first light mixing element.

Passage 48. A lighting device as recited in passage 47, wherein:

at least some of the light that is reflected at least once within the first light mixing element is reflected:

(1) at an external surface of the first light mixing element;

(2) at an interface between a first region of the first light mixing element and a second region of the first light mixing element; and/or (3) at a surface of a second region of the first light mixing element.

Passage 49. A lighting device as recited in passage 47 or passage 48, wherein the lighting device comprises at least second, third, fourth and fifth solid state light emitters in addition to the first solid state light emitter.

Passage 50. A lighting device as recited in any one of passages 47-49, wherein the lighting device comprises a plurality of solid state light emitters including the first solid state light emitter, and a brightness of light emitted by the plurality of solid state light emitters exiting the first light mixing element is at least 500 lumens Passage 51. A lighting device as recited in any one of passages 47-50, wherein the exit aperture has a dimension that is at least six times the largest dimension of the first light mixing element.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices described herein can be provided in two or more parts (which may be held together in any known way, e.g., with adhesive, screws, bolts, rivets, staples, etc.).

The invention claimed is:

1. A lighting device, comprising:

at least a first solid state light emitter; and at least a first light mixing element, at least some light emitted by the first solid state light emitter entering the first light mixing element and then exiting the first light mixing element, at least 10 percent of light emitted by the first solid state light emitter that enters the first light mixing element is reflected at least once within the first light mixing element, a largest dimension of the first light mixing element is not larger than 16 mm, the exit region of the first light mixing element having a surface area between about 50% to about 300% of the surface area of the entrance region.

2. A lighting device as recited in claim 1, wherein the lighting device further comprises at least a first light output shaping element, and at least some light emitted by the first solid state light emitter enters the first light mixing element, then exits the first light mixing element into the first light output shaping element, and then exits the lighting device.

3. A lighting device as recited in claim 1, wherein:

at least 80 percent of a total amount of light emitted by the first solid state light emitter enters an entrance region of the first light mixing element, at least 70 percent of a total amount of light emitted by the first solid state light emitter that enters the first light mixing element exits from an exit region of the first light mixing element, and the lighting device further comprises at least a first light output shaping element that defines an exit aperture having a surface area that is at least eight times the surface area of the exit region of the first light mixing element.

4. A lighting device as recited in claim 1, wherein the first light mixing element comprises at least a first mixing element region and a second mixing element region.

5. A lighting device as recited in claim 1, wherein a brightness of light exiting the first light mixing element is at least 500 lumens.

6. A lighting device as recited in claim 1, wherein the lighting device comprises at least second, third, fourth and fifth solid state light emitters in addition to the first solid state light emitter.

7. A lighting device as recited in claim 6, wherein:

the first solid state light emitter is configured to emit light within a first region on a 1976 CIE Chromaticity Diagram, the second solid state light emitter is configured to emit light within a second region on a 1976 CIE Chromaticity Diagram, each point within the first region is spaced from each point within the second region by at least 0.01 u', v' units on a 1976 CIE Chromaticity Diagram.

8. A lighting device, comprising:

at least a first solid state light emitter; and at least a first light mixing element, the first light mixing element comprising at least a first mixing element region and a second mixing element region, at least some light emitted by the first solid state light emitter entering the first light mixing element and then exiting the first light mixing element, the second mixing element region defining at least a first aperture, the second mixing element region covering a surface of the first mixing element region except for at least a first exit region of the first mixing element region which is exposed to the first aperture, a largest dimension of the first light mixing element is not larger than 16 mm.

9. A lighting device as recited in claim 8, wherein:

the first mixing element region comprises a first structure, the second mixing element region comprises a second structure, and the first structure is solid.

10. A lighting device as recited in claim 8, wherein:

at least some of the light that is reflected by the second mixing element region is reflected:

(1) at an external surface of the first light mixing element;

(2) at an interface between the first mixing element region and the second mixing element region;

(3) at a surface of the second mixing element region; and/or (4) within the second mixing element region.

11. A lighting device as recited in claim 8, wherein:

at least 80 percent of a total amount of light emitted by the first solid state light emitter enters an entrance region of the first light mixing element, at least 70 percent of a total amount of light emitted by the first solid state light emitter that enters the first light mixing element exits from an exit region of the first light mixing element, the exit region of the first light mixing element has a surface area between about 50% to about 300% of the surface area of the entrance region.

12. A lighting device as recited in claim 8, wherein the lighting device further comprises at least a first light output shaping element, and at least some light emitted by the first solid state light emitter enters the first light mixing element, then exits the first light mixing element into the first light output shaping element, and then exits the lighting device.

13. A lighting device as recited in claim 8, wherein a brightness of light exiting the first light mixing element is at least 500 lumens.

14. A lighting device as recited in claim 8, wherein the lighting device comprises at least second, third, fourth and fifth solid state light emitters in addition to the first solid state light emitter.

15. A lighting device as recited in claim 14, wherein:

the first solid state light emitter is configured to emit light within a first region on a 1976 CIE Chromaticity Diagram, the second solid state light emitter is configured to emit light within a second region on a 1976 CIE Chromaticity Diagram, each point within the first region is spaced from each point within the second region by at least 0.01 u', v' units on a 1976 CIE Chromaticity Diagram.

16. A lighting device, comprising:

at least a first solid state light emitter; and at least a first light mixing element, at least 80 percent of a total amount of light emitted by the first solid state light emitter entering an entrance region of the first light mixing element, at least 10 percent of light emitted by the first solid state light emitter that enters the first light mixing element is reflected at least once within the first light mixing element, at least 70 percent of a total amount of light emitted by the first solid state light emitter that enters the first light mixing element exiting from an exit region of the first light mixing element, and the exit region of the first light mixing element having a surface area between about 50% to about 300% of the surface area of the entrance region.

17. A lighting device as recited in claim 16, wherein:

the lighting device further comprises at least a first light output shaping element, and the first light output shaping element defines an exit aperture having a surface area that is at least sixteen times the surface area of the exit region of the first light mixing element.

18. A lighting device as recited in claim 16, wherein a largest dimension of the first light mixing element is not larger than 16 mm.

19. A lighting device as recited in claim 16, wherein the lighting device further comprises at least a first light output shaping element, and at least some light emitted by the first solid state light emitter enters the first light mixing element, then exits the first light mixing element into the first light output shaping element, and then exits the lighting device.

20. A lighting device, comprising:

at least a first solid state light emitter;

at least a first light mixing element; and at least a first light output shaping element, at least 10 percent of light emitted by the first solid state light emitter that enters the first light mixing element is reflected at least once within the first light mixing element, at least some light emitted by the first solid state light emitter entering the first light mixing element, then exiting the first light mixing element into the first light output shaping element, and then exiting the lighting device, and the first light output shaping element defining an exit aperture having a dimension that is at least three times a largest dimension of the first light mixing element.

21. A lighting device as recited in claim 20, wherein the exit aperture has a dimension that is at least six times the largest dimension of the first light mixing element.

22. A lighting device, comprising:

at least first and second solid state light emitters; and at least a first light mixing element, at least some light emitted by the first solid state light emitter entering the first light mixing element and then exiting the first light mixing element, at least 10 percent of light emitted by the first solid state light emitter that enters the first light mixing element is reflected at least once within the first light mixing element, a largest dimension of the first light mixing element not larger than 16 mm, the first solid state light emitter configured to emit light within a first region on a 1976 CIE Chromaticity Diagram, the second solid state light emitter configured to emit light within a second region on a 1976 CIE Chromaticity Diagram, and each point within the first region spaced from each point within the second region by at least 0.01 u', v' units on a 1976 CIE Chromaticity Diagram.

23. A lighting device, comprising:

at least a first solid state light emitter; and at least a first light mixing element, the first light mixing element comprising at least a first mixing element region and a second mixing element region, at least 80 percent of a total amount of light emitted by the first solid state light entering an entrance region of the first light mixing element, at least 70 percent of a total amount of light emitted by the first solid state light emitter that enters the first light mixing element exiting from an exit region of the first light mixing element, the exit region of the first light mixing element having a surface area between about 50% to about 300% of the surface area of the entrance region, and a largest dimension of the first light mixing element not larger than 16 mm.

24. A lighting device, comprising:

at least a first solid state light emitter;

at least a first light mixing element; and at least a first light output shaping element, the first light mixing element comprising at least a first mixing element region and a second mixing element region, at least some light emitted by the first solid state light emitter entering the first light mixing element and then exiting the first light mixing element, a largest dimension of the first light mixing element is not larger than 16 mm, at least some light emitted by the first solid state light emitter entering the first light mixing element, then exiting the first light mixing element into the first light output shaping element, and then exiting the lighting device.

25. A lighting device, comprising:

at least a first solid state light emitter; and at least a first light mixing element, at least 80 percent of a total amount of light emitted by the first solid state light emitter enters an entrance region of the first light mixing element, at least 70 percent of a total amount of light emitted by the first solid state light emitter that enters the first light mixing element exits from an exit region of the first light mixing element, and the lighting device further comprises at least a first light output shaping element that defines an exit aperture having a surface area that is at least eight times the surface area of the exit region of the first light mixing element.

26. A lighting device, comprising:

at least first and second solid state light emitters; and at least a first light mixing element, the first light mixing element comprising at least a first mixing element region and a second mixing element region, at least some light emitted by the first solid state light emitter entering the first light mixing element and then exiting the first light mixing element, a largest dimension of the first light mixing element not larger than 16 mm, the first solid state light emitter configured to emit light within a first region on a 1976 CIE Chromaticity Diagram, the second solid state light emitter configured to emit light within a second region on a 1976 CIE Chromaticity Diagram, each point within the first region spaced from each point within the second region by at least 0.01 u', v' units on a 1976 CIE Chromaticity Diagram.

* * * * *